US008127586B1

(12) United States Patent
Gunst

(10) Patent No.: US 8,127,586 B1
(45) Date of Patent: Mar. 6, 2012

(54) MOVEMENT DEVICE FOR A DIE

(76) Inventor: Robert J. Gunst, Fair Haven, MI (US)

( * ) Notice: Subject to any disclaimer, the term of this patent is extended or adjusted under 35 U.S.C. 154(b) by 686 days.

(21) Appl. No.: 12/316,058

(22) Filed: Dec. 9, 2008

Related U.S. Application Data

(60) Provisional application No. 61/007,185, filed on Dec. 10, 2007.

(51) Int. Cl.
*B21J 13/08* (2006.01)
*B21D 43/05* (2006.01)

(52) U.S. Cl. ..... 72/405.16; 72/405.13; 72/421; 198/621.1; 198/621.3

(58) Field of Classification Search ..... 72/405.01, 72/405.09, 405.13, 405.16, 421; 198/621.1, 198/621.3
See application file for complete search history.

(56) References Cited

U.S. PATENT DOCUMENTS

| | | | | | |
|---|---|---|---|---|---|
| 2,929,485 | A | * | 3/1960 | Wallis | 198/621.1 |
| 3,105,399 | A | * | 10/1963 | Strugala et al. | 72/405.13 |
| 3,138,128 | A | * | 6/1964 | Suofy | 72/405.13 |
| 3,165,192 | A | | 1/1965 | Wallis | 198/19 |
| 3,411,636 | A | * | 11/1968 | Wallis | 198/621.1 |
| 3,421,637 | A | * | 1/1969 | Sofy | 198/621.1 |
| 3,707,908 | A | | 1/1973 | Merk et al. | 100/207 |
| 3,754,667 | A | | 8/1973 | Storch | 214/188 |
| 3,756,425 | A | | 9/1973 | Wallis | 214/188 |
| 3,939,992 | A | | 2/1976 | Mikulec | 214/188 |
| 4,198,845 | A | * | 4/1980 | Sofy | 72/421 |
| 4,311,429 | A | | 1/1982 | Wallis | 414/750 |
| 4,331,315 | A | | 5/1982 | Geisow | 251/14 |
| 4,513,602 | A | | 4/1985 | Sofy | 72/405 |
| 4,540,087 | A | | 9/1985 | Mizumoto | 198/621 |
| 4,735,303 | A | | 4/1988 | Wallis | 198/621 |
| 4,833,908 | A | | 5/1989 | Sofy | 72/405 |
| 4,852,381 | A | | 8/1989 | Sofy | 72/405 |
| 4,895,013 | A | | 1/1990 | Sofy | 72/405 |
| RE34,581 | E | | 4/1994 | Sofy et al. | 72/405 |
| 6,327,888 | B1 | | 12/2001 | Kadlec | 72/405.16 |
| 6,408,670 | B1 | | 6/2002 | Trapp | 72/328 |
| 7,249,546 | B1 | | 7/2007 | Fosnaugh | 83/50 |

OTHER PUBLICATIONS

Gunst, U.S. Appl. No. 61/007,185, filed Dec. 10, 2007 A. D.
HMS Products Co., Welcome to HMS Products Co., 2 pp. (www.hmsproducts.com), 2006, Downloaded May 27, 2007.
Industrial Press, Inc., Machinery's Handbook 28th Edition, pp. 2190-2196 (www.industrialpress.com), 2008.

* cited by examiner

*Primary Examiner* — David Jones
(74) *Attorney, Agent, or Firm* — Christopher John Rudy

(57) ABSTRACT

Mechanical converter in a movement device generally for transferring parts with respect to a die converts slave motion in a first direction into basic motions of a drive motion in a second direction different from the first direction, and a pitch motion in a third direction different from the first and second directions, which may be such that it is not converted through a plate or rotating cam. Additional motion(s) of an elevation motion in a fourth direction different from the second and third directions but including a vector component along or opposite to the first direction and/or further motion(s) radial to one or more of the first, second, third or fourth directions may be provided from the mechanical converter, another mechanical converter and/or from another source. Also, assisting motion(s), which can assist the die in performing an operation on a work piece, i.e., part, can be provided, for example, by drawing a motion from the pitch, drive and/or elevation motion(s).

20 Claims, 29 Drawing Sheets

51B
50
51
50B 50
51B
51
50B 50
51B
51
50B 50
10C
10E'
27,28,
29,30
50B

10E''
10E
51
50A'
10
27,28,
29,30

10D'
10D
10B
10E
10C
10E'
10E''
10A
50A'
10A
10
10D'
10D
10B
50
50A
55
51A
51
10

58B
58
51B
51
50
50B
58B 58
58B
51
50A
10C
50B
36
36
51B
50
10B
50A'
10
51
50A'
10B
10
57B
50B
51B
51
57B
57
50
57
50B
51B 51B
57B
50B
51
50A
10C
57
33
33
50
50A'
10B
10
88
51
50A'
10B
10

62
61
50
51

51
10C
62
61
50
42
42
10

10B
10

10B
60B
50
59
51B
60
51
50B 51
50B
10C
60B
59
50
60
39
39
51B
10B
10

51B
60
59
50B
60'
10B
10

MOVEMENT DEVICE FOR A DIE

This claims the benefits under 35 USC 119(e) of provisional patent application No. 61/007,185 filed on Dec. 10, 2007 A.D. The complete specification of that application to include its drawings is incorporated herein by reference.

FIELD AND PURVIEW OF THE INVENTION

This concerns a movement device for transferring parts for, through and/or in a die such as a progressive die, and its use. It permits a progressive die to work like and have advantages of a transfer die. Various motion(s) can originate with the same slave, and assisting motion(s) can be provided with power take off (PTO) from other motion(s).

BACKGROUND TO THE INVENTION

A progressive die is one of the most common of dies, and, in use, one of the fastest, for making sheet metal stamped parts. Finished edges of the parts are tied together by a portion of the original strip or coil called a carrier, bridge, ribbon, etc. which becomes "off-fall," i.e., waste. See, e.g., U.S. Pat. No. 7,249,546 B1 to Fosnaugh.

A carrierless progressive die is a progressive die without a carrier between parts to tie the parts together. Instead, parts are connected finished edge to finished edge, eliminating off-fall. See, e.g., U.S. Pat. No. 6,408,670 B1 to Trapp.

Transfer dies are special line dies that are timed together and properly spaced an even distance apart in press(es). Sheet metal stamped parts are transferred by special traveling rails mounted within the press boundaries, and there is no carrier between parts. These rails most commonly are mounted on each side of the dies. During the press cycle, each rail travels inward, grabs the part with special fingers, and then transfers it to the next die. See, e.g., U.S. Pat. No. 4,513,602 to Sofy.

Some typical advantages and disadvantages of each type of die are listed below.

Progressive die advantages typically include:
- A great volume of parts can be produced very quickly.
- It can be run unattended.
- Only one press is required.
- The press is smaller than a transfer press.
- It is usually less costly to produce than larger, more complex transfer dies.

Progressive die disadvantages typically include:
- Due to the carrier, more material is used than in carrierless progressive or transfer dies.
- Parts cannot be turned over or rotated during the stamping process.
- Access to the part profile is limited due to the carrier.
- Progression, i.e., distance between parts, on the stamping line is fixed.

Carrierless progressive die advantages typically include:
- A great volume of parts can be produced very quickly.
- It can be run unattended.
- Only one press is required.
- The press is smaller than a transfer press.
- It is usually less costly to produce than larger, more complex transfer dies.
- No carrier between parts is present, which allows for material savings.

Carrierless progressive die disadvantages typically include:
- Parts cannot be turned over or rotated during the stamping process.
- Access to the part profile is limited by the finished edge to finished edge contact.

- Progression on the stamping line is fixed.

Transfer die system advantages typically include:
- Large parts can be handled at fairly rapid speeds.
- Parts can be turned over or rotated during the stamping process.
- Parts have no carrier, allowing for material savings.
- Access to the entire part profile is available.
- Progression on the stamping line can be varied.

Transfer die system disadvantages typically include:
- More than one press may be required, usually quite large.
- Often a high cost is entailed to make or purchase the movement device of the system.
- A somewhat unpredictable installation cost can be entailed.
- Systems are is usually specific to and made for certain applications only, i.e., They are usually "custom" or "customized" items, not "off the shelf" items.
- Sophisticated electronics and mechanical finger motion are often required to function properly.
- More die protection sensors are required than for progressive and carrierless progressive dies.
- Pitch, i.e., re-created progression typically on a horizontal plane, motion is mechanically separated from drive motion, i.e., motion typically orthogonal to pitch on the horizontal plane, adding complexity and synchronization problems.

It is also known in a progressive die to remove the carrier and perform work on the separated part. One simple example of this may be considered to be where, in a progressive die, the carrier feature is cut off at the last station to leave the part, and a simple mechanical device is used to move the separated part away from the line, perhaps to work on it. Some typical advantages of such a system typically include advantages similar to those attending progressive or carrierless progressive dies such as listed above; the system can be bought off the shelf; and relative simplicity is maintained. Some typical disadvantages of such a system typically include disadvantages similar to those attending progressive or carrierless progressive dies such listed above; more varied work is limited until the end of the line; only one station is available for such additional varied work; limited motion is provided; and essentially this amounts to a mere ejection device. At the other extreme, the carrier feature may be removed after the first station on a progressive line, and a sophisticated device is used to move the separated part to successive transfer stations to work on it, thus providing progressive and transfer capabilities. See, e.g., U.S. Pat. No. Re. 34,581 (from U.S. Pat. No. 4,833,908) to Sofy et al. Some typical advantages of such a system typically include advantages attending transfer die systems such as listed above; and pre-work can be carried out on the part such as oiling, cleaning, pre-forming, for which progressive or carrierless progressive dies are noted. Some typical disadvantages of such a system typically include disadvantages similar to those attending transfer die systems such as listed above; the system remains expensive, big, and complex; access to tooling can be severely limited because it is buried within the transfer system structure, therefore, with maintenance and re-tooling difficult; and the pitch motion providing device in the transfer stations is still mechanically separate from drive, with complexity and synchronization problems remaining.

Additional art is known. See, U.S. Pat. Nos. 3,165,192 to Wallis; 3,707,908 to Merk et al.; 3,754,667 to Storch; 3,756,425 to Wallis; 3,939,992 to Mikulec; 4,311,429 to Wallis; 4,540,087 to Mizumato; and 4,895,013 to Sofy. See also, U.S. Pat. Nos. 3,939,992 to Mikulec; 4,735,303 to Wallis; and 4,852,381 to Sofy; plus U.S. Pat. No. 6,327,888 B1 to Kadlec. Note, U.S. Pat. No. 4,331,315 to Geisow.

It would be desirable to improve upon or supply an alternative to the art.

A FULL DISCLOSURE OF THE INVENTION

In general, the present invention provides a movement device for a die comprising a mechanical converter that converts slave motion in a first direction into basic motions of a drive motion in a second direction different from the first direction, and a pitch motion in a third direction different from the first and second directions. The mechanical converter which provides conversion to the drive and pitch motions may be such that it is not converted through a plate or rotating cam. Additional motion(s) of an elevation motion in a fourth direction different from the second and third directions but including a vector component along or opposite to the first direction and/or further motion(s) radial to one or more of the first, second, third or fourth directions may be provided from the aforesaid mechanical converter, another mechanical converter and/or from another source. Also, assisting motion(s), which can assist the die in performing an operation on a work piece, i.e., part, can be provided, for example, by drawing a motion from the pitch, drive and/or elevation motion(s). The movement device is generally for transferring parts with respect to the die. Provided also are the movement device in combination with the die, and use of the same.

The invention is a useful in the manufacture of sheet metal and other parts.

Significantly, by the invention, the art is improved in kind. More particularly, the invention provides a movement device that allows a progressive die to function along its line with no carrier or with a reduced carrier. Die operations are improved. Various advantages of both progressive, including carrierless progressive, and transfer dies are incorporated, with various disadvantages of the same ameliorated if not overcome. Manufacturing capability of the present device when connected to the progressive die can be similar to that of a transfer die. However, two or even three or four or more motions can be mechanically associated with and provided from the same slave. Plate or rotating cam features and electrical servo, linear or rotational motor, fluid-actuated and so forth features can be avoided or employed in certain motions such as the noted additional motions as may be desired. A rack and pinion system, for example, can be employed to efficiently provide the required motions with assurance, including lost motion and/or overlap motion such as, for example, established with respect to drive and elevation motions. Motion(s) can be provided as linear or non-linear with respect to the motion provided by the slave motion. Complexity of structure can be reduced in comparison to transfer die systems, and synchronization problems can be ameliorated if not effectively eliminated. Moreover, accurate and precise motion, which may itself be complex, is maintained if not improved. The size of the present device, moreover, can be many times smaller than that of existing transfer die systems, say, with the device being the size of a bread box or even smaller, and this smaller size can provide for ready incorporation into progressive dies. Maintenance and re-tooling of the die is made easier, and great variability in the types of tooling can be employed. The present device is relatively simple. Standard, off the shelf or customized movement device units of specific pitch, drive, elevation and/or rotation, and mix and match capability can be provided. Different movements at different stations of the same die with separate movement devices, which, again, can be relatively small, can be provided. Modularity in the movement device itself can be provided to provide ready changes in movements and functions. Changes in movement and function with respect to the same slave motion can be predetermined, for instance, with respect to cycle timing and/or distance that a particular motion travels. As illustrations, with a six-inch down and up slave motion, an elevation down (de-elevation) motion could be predetermined to occur about from 1:30 to 3:00 o'clock or about from 2:00 to 3:30 o'clock with respect to a die cycle timing chart; drive out could be about from 3:00 to 4:30 o'clock or about from 2:00 to 3:30 o'clock with respect to the die cycle timing chart; pitch return could be about from 4:30 to 6:00 o'clock or about from 3:30 to 5:30 with respect to the die cycle timing chart; and so forth. As further illustrations, the drive motion could be predetermined to be about two inches out with a one-inch elevation motion or, say, 2-½ inches out with a ½-inch elevation, with the elevation motion being optional; the pitch motion could be predetermined to be six inches or, say, four inches, forward. Similarly, for illustration, a rotation (pivot) motion for rotating a work piece could be predetermined to coincide with a pitch motion and be 180° or or say, 90°, 60°, 45°, 30°, or 27°; and so forth. Additionally, different slave distances, for purposes of illustration encountered as a linear slave distance, can be accommodated with longer or shorter rack drivers, and so forth. Assisting motion(s) can be provided in a form of a PTO transfer system, for instance, from any of the pitch, drive and elevation motions. Thus, versatility in application to a particular need can be provided in a predetermined fashion. The movement device can be made, installed, operated, maintained and repaired efficiently and effectively. A completely mechanical operation within the movement device to provide for all of the movements can be provided. With its modularity and smaller size as well as its employment of little or no carrier for work pieces, significant cost savings can be achieved with the present device. The device is "user-friendly."

Numerous further advantages attend the invention.

The drawings form part of the specification hereof. With respect to the drawings, which are not necessarily drawn to scale, the following is briefly noted:

FIGS. 1, 1A and 1B are sample die cycle timing charts, with which cycle positions may be correlated. Motion(s) may be chosen independently and made into another chart. For purposes of illustration, herein, cycle positions (o'clock designations) are provided in reference to FIGS. 1, 1A and 1B as appropriate.

FIGS. 2 and 2A are perspective views, with portions in section, which show general assemblies of a die with movement devices for transferring parts therefore, with FIG. 2 illustrating such an assembly with one opposing pair of such movement devices and FIG. 2A illustrating such an assembly with dual opposing pairs of such movement devices. Their positions are taken at about the 12:00 o'clock position of the cycle.

Figure 4:
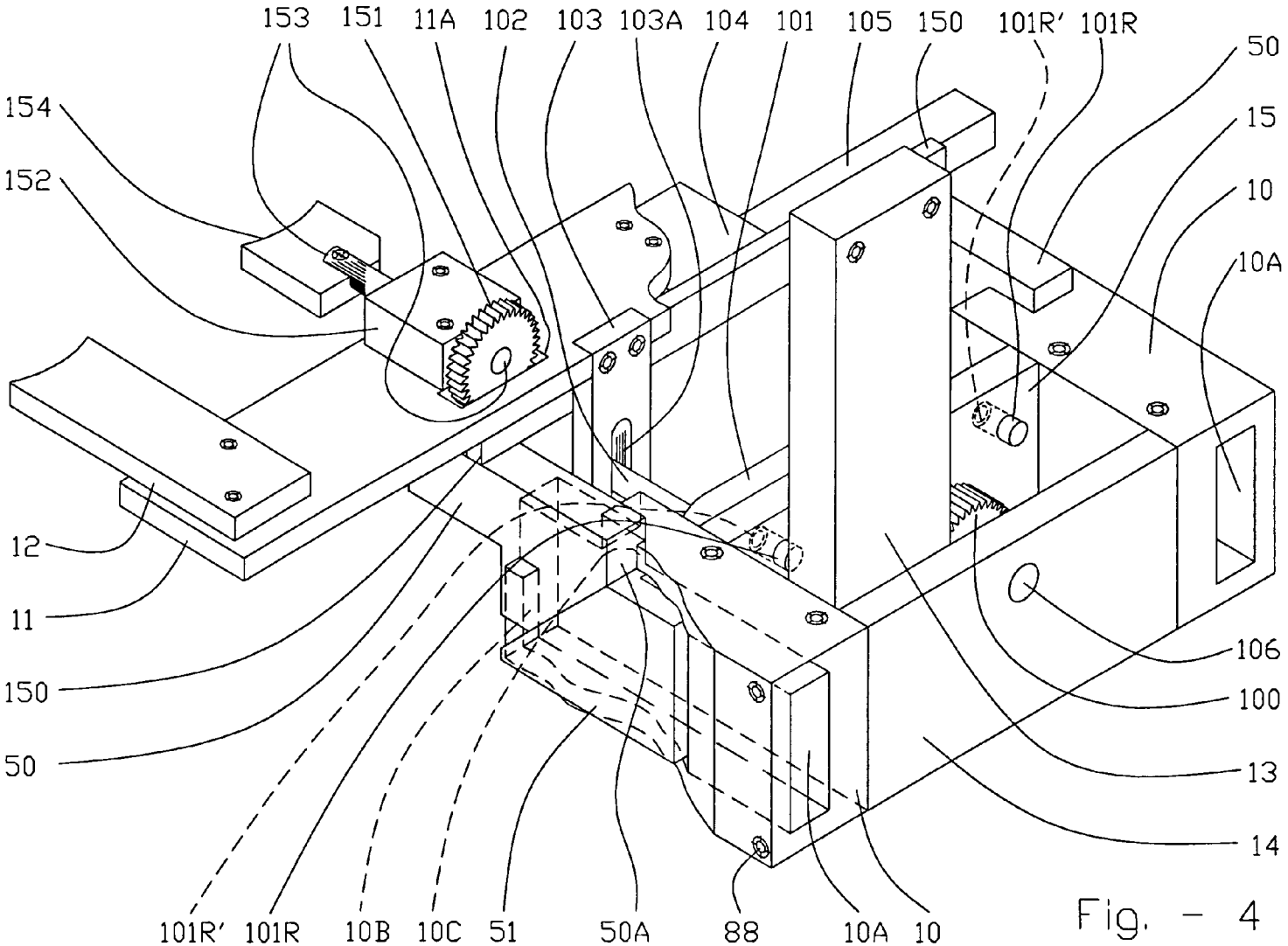
FIG. 4 is a perspective plan view with portions in section of one of a pair of the movement devices such as found in FIGS. 2 and 3. The position is about 12:00 o'clock.
Figure 5:
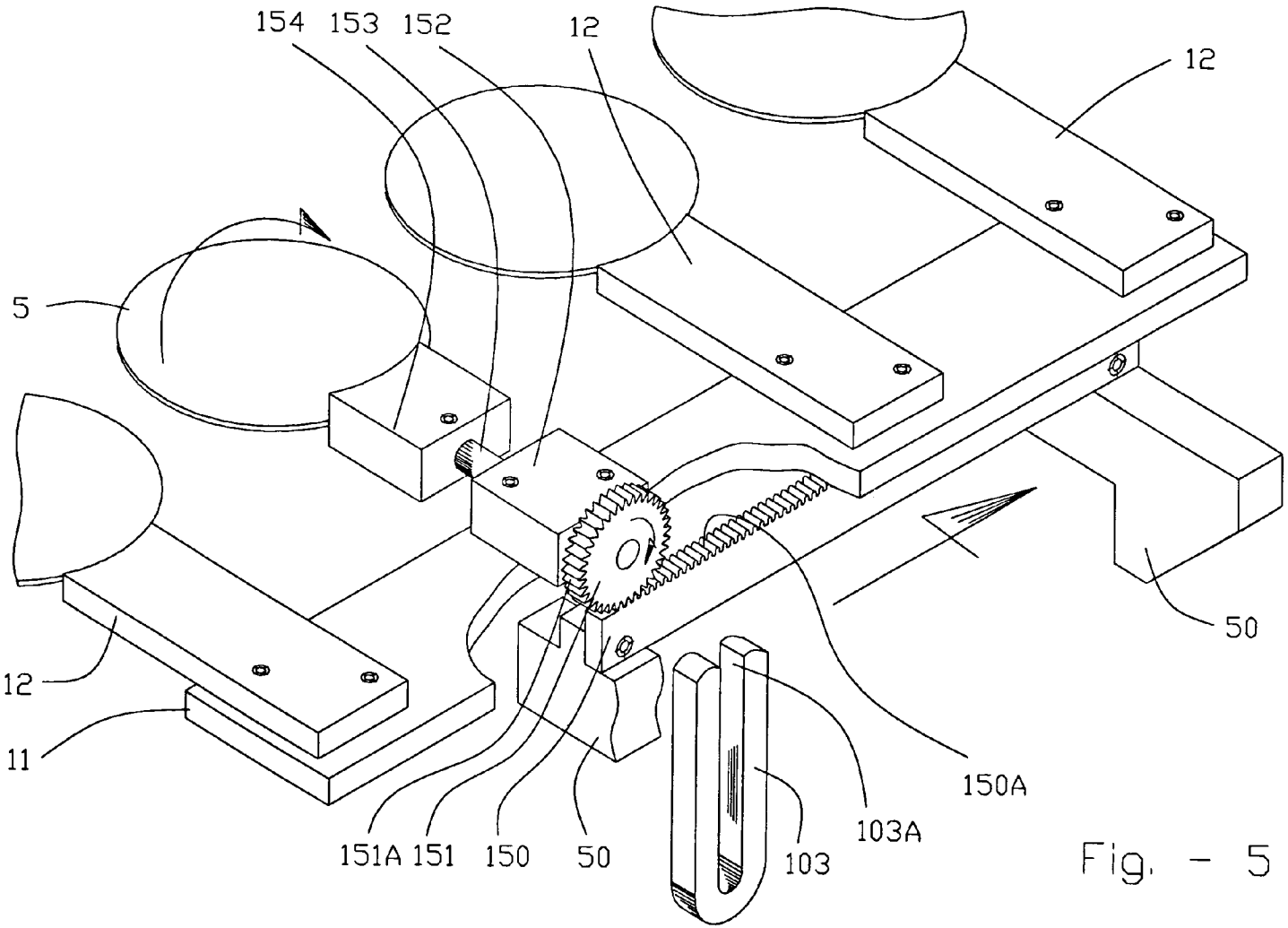
Figure 5A:
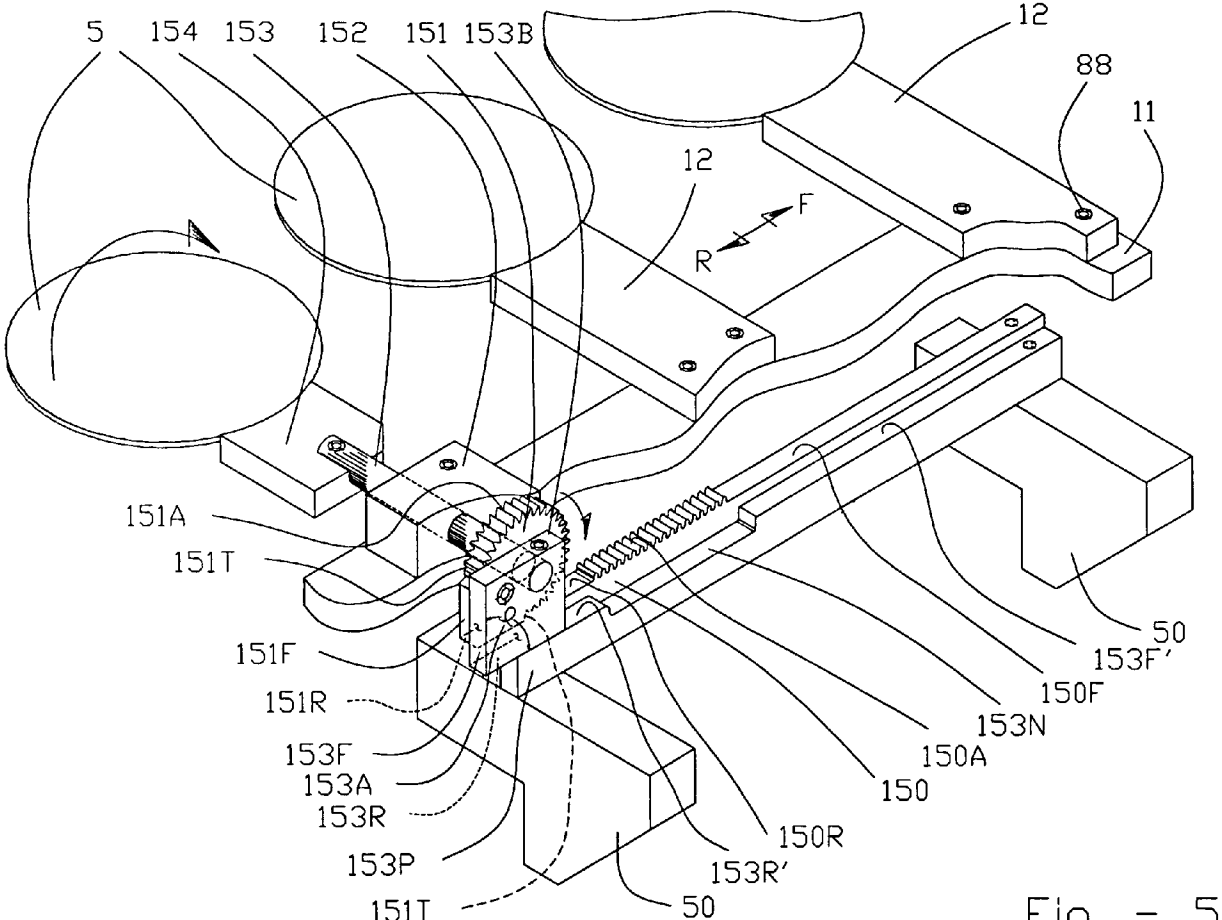

FIGS. 5 and 5A are perspective plan views with portions in section of part of the movement device illustrated in FIG. 4 (FIG. 5) and of part of a movement device that can be employed in the movement device as otherwise illustrated in FIG. 4 (FIG. 5A). Each of these illustrate end of a motion of rotation. Their positions are about 12:00 o'clock.

Figure 6:
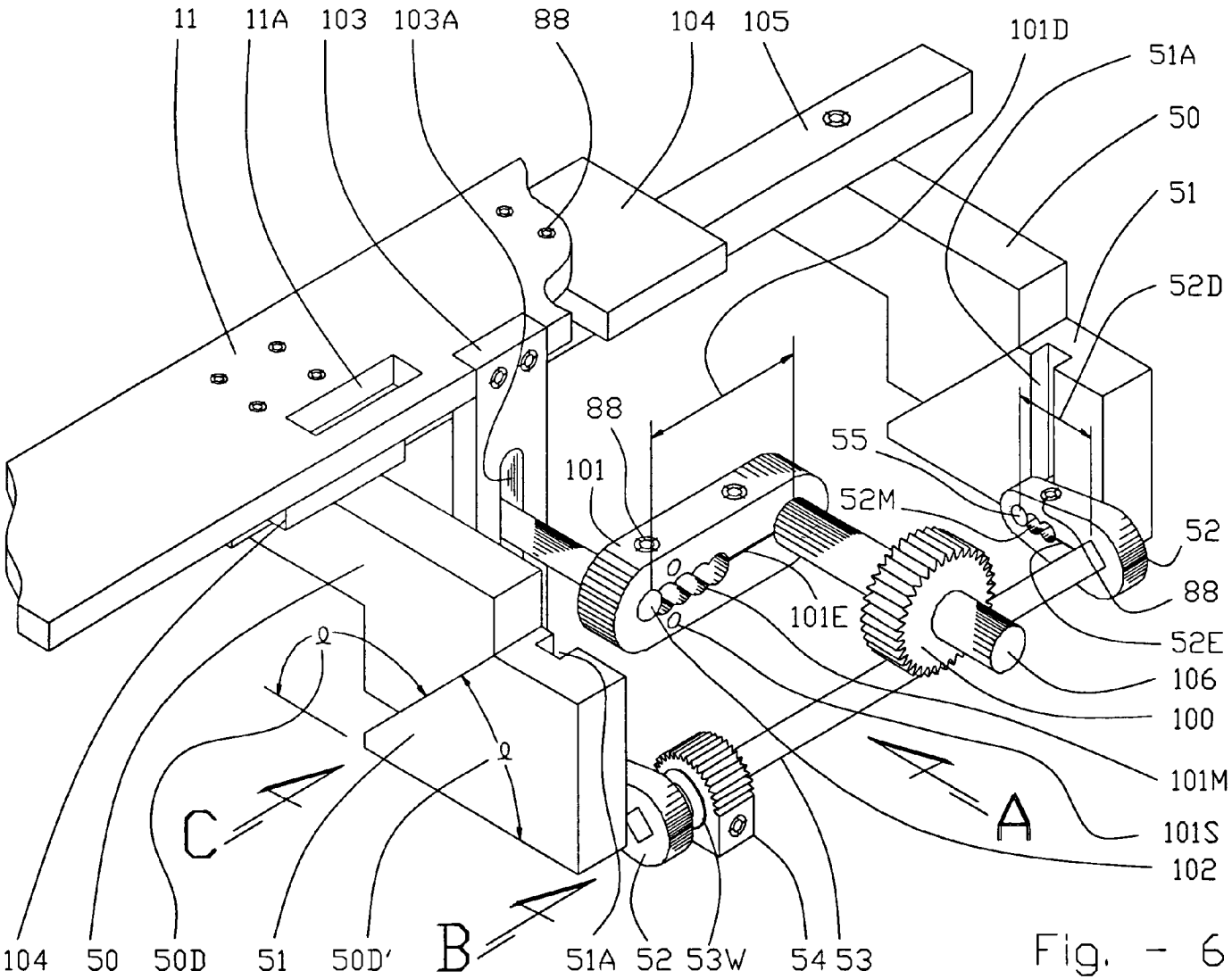

FIG. 6 is a perspective plan view of part of the movement device of FIG. 4, which illustrates end of a motion of progress forward and initial period of no motion. The position is about 12:00 o'clock.

Figure 7:
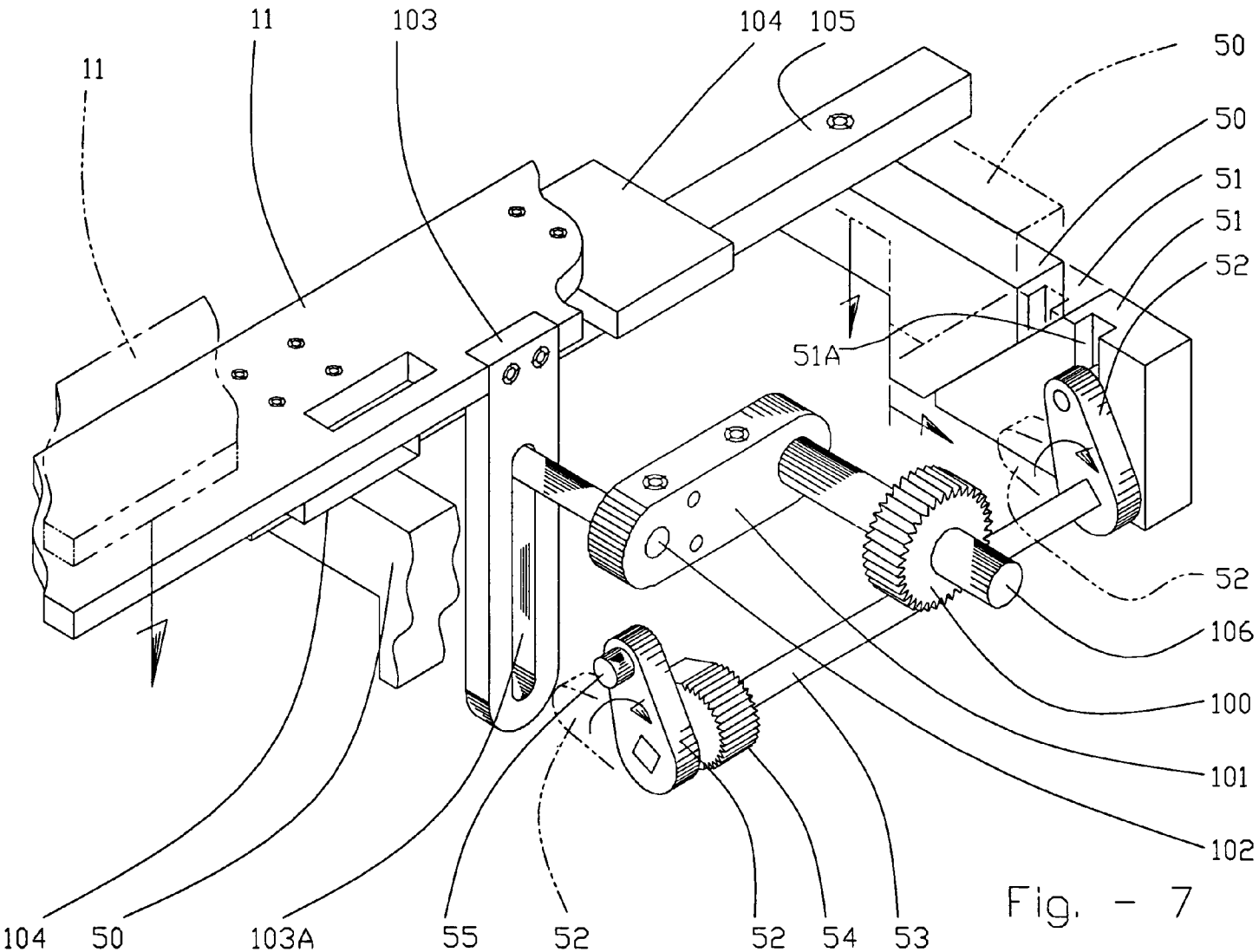

FIG. 7 is a perspective plan view of part of the movement device of FIG. 4, which illustrates a motion of elevation down (de-elevation). The position is about 3:00 o'clock.

Figure 8:
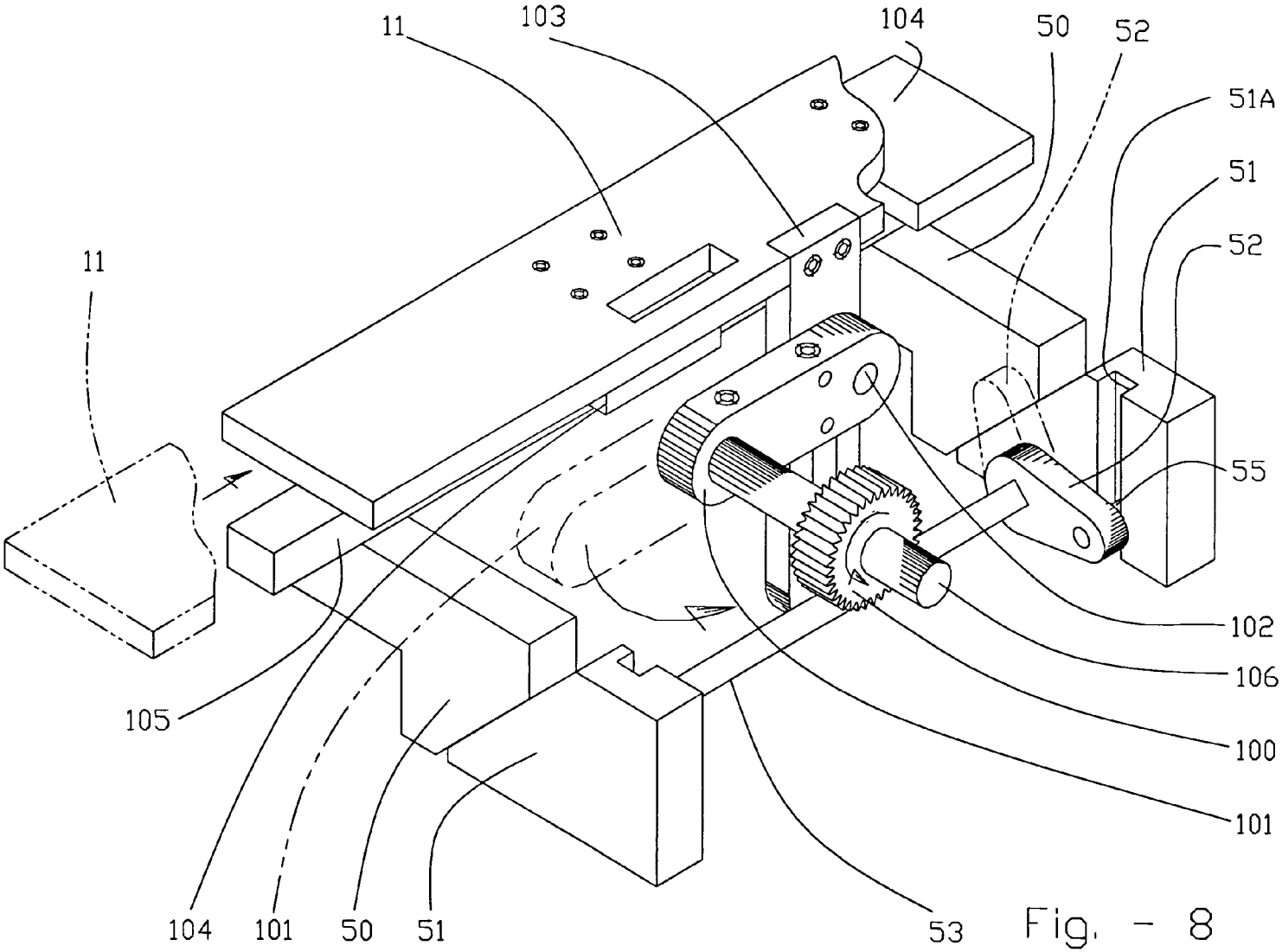

FIG. 8 is a perspective plan view of part of the movement device of FIG. 4, which illustrates motions of pitch and drive. The position is about 6:00 o'clock.

Figure 9:
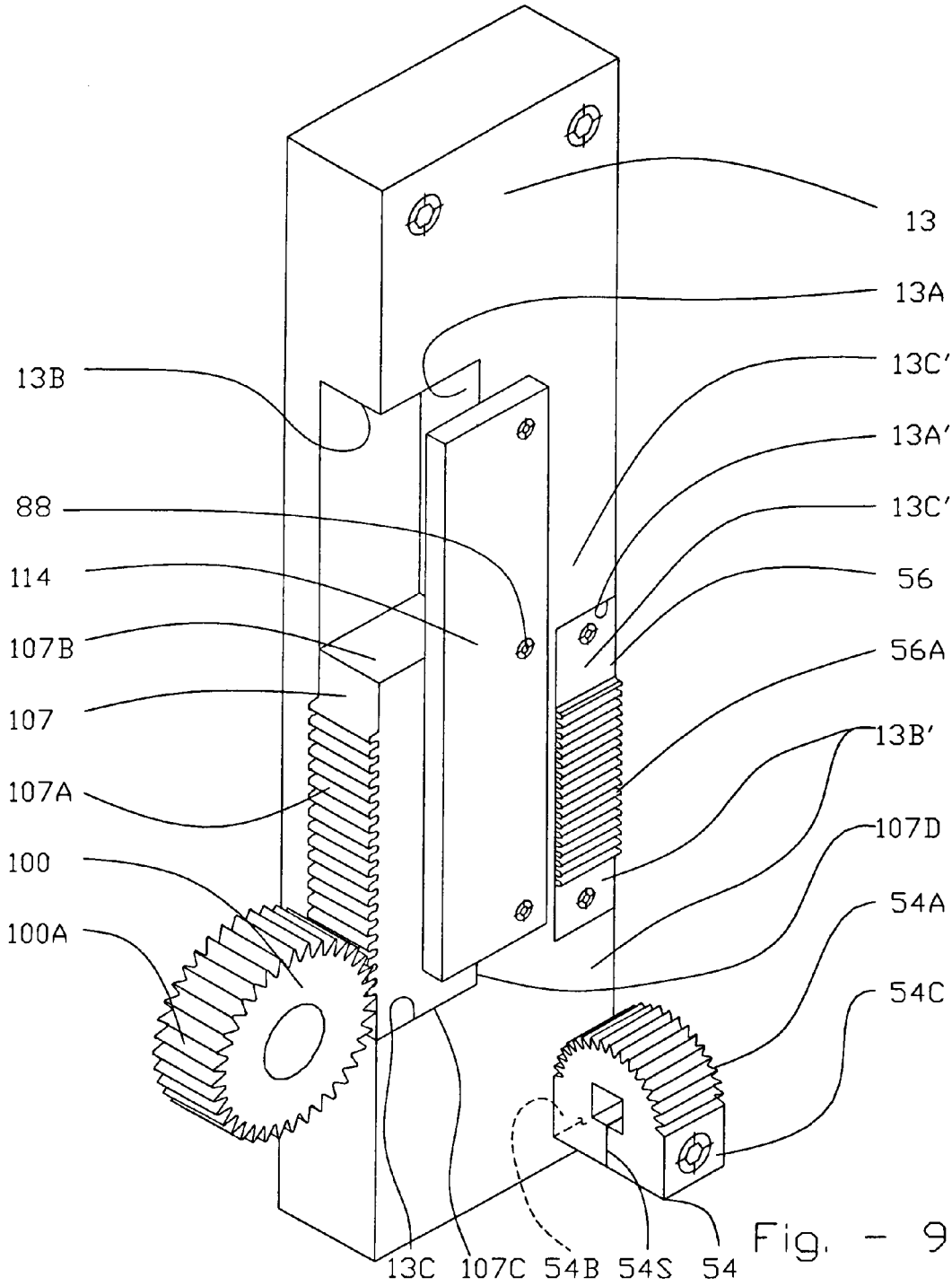

FIG. 9 is a perspective view of a rack driver and some associated parts and gears in the movement device of FIG. 4. A modular progress rack, movable with respect to the rack driver, is illustrated as being employed. The position is about 12:00 o'clock.

Figure 10:
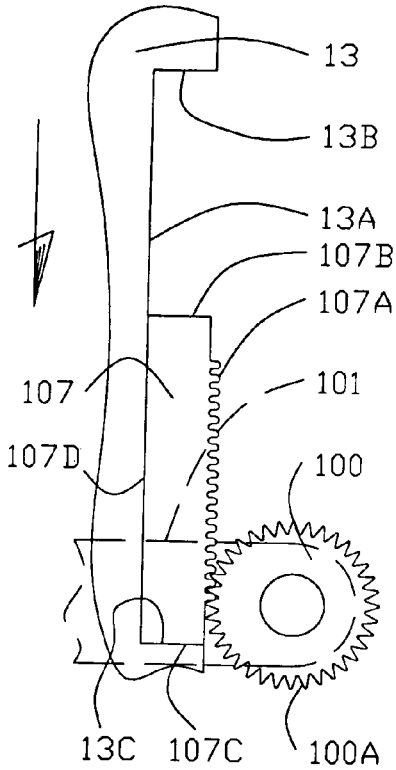

FIG. 10 is a plan view taken along arrow "A" of FIG. 6 of a rack driver, progress rack and progress gear as found in the movement device of FIGS. 4 and 9, shown with its associated arm. The cycle position is about 12:00 o'clock.

Figure 11:
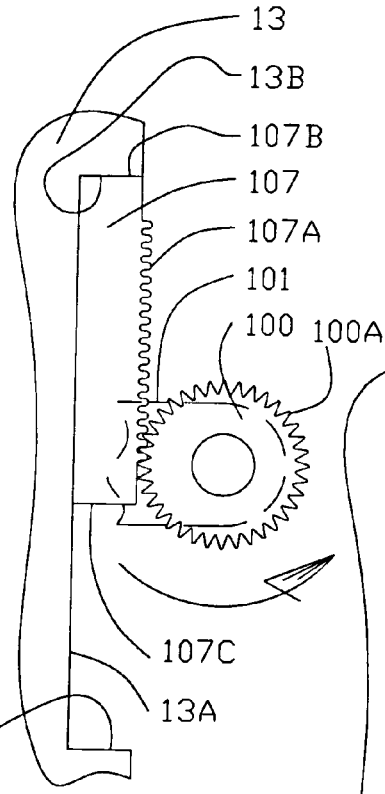

FIG. 11 is a plan view taken along arrow "A" of FIG. 6 of the rack driver, progress rack and progress gear with arm of FIG. 10. The position is about 3:00 o'clock.

Figure 12:
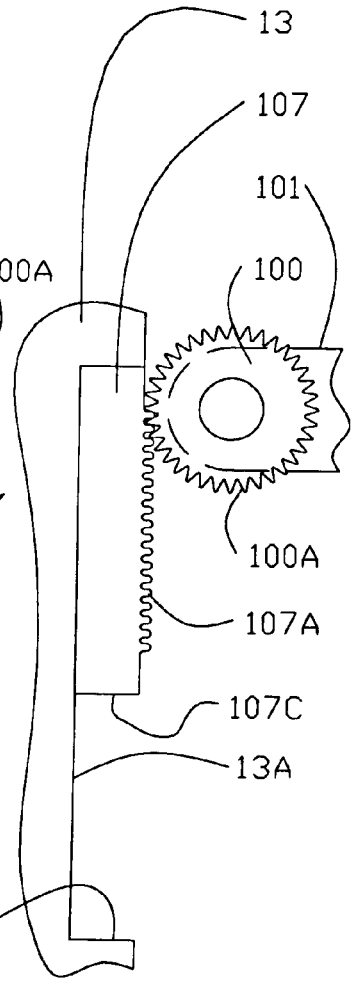

FIG. 12 is a plan view taken along arrow "A" of FIG. 6 of the rack driver, progress rack and progress gear with arm of FIG. 10. The position is about 6:00 o'clock.

Figure 13:
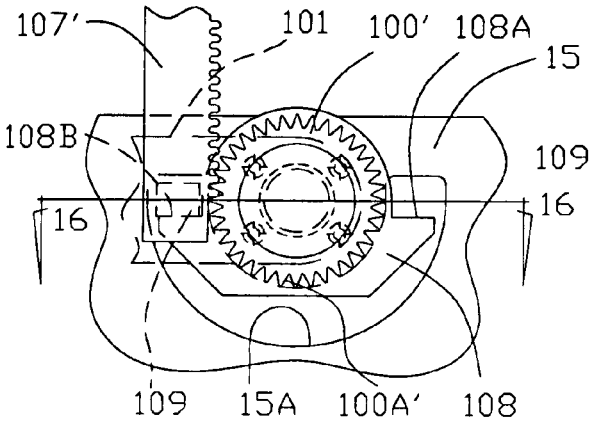

FIG. 13 is a plan view taken as along arrow "A" of FIG. 6 of another embodiment of a rack driver, progress rack, progress gear and associated parts, otherwise employable in a movement device as of FIGS. 4 and 9. A modular progress rack, stationary with respect to the rack driver, is illustrated. The cycle position is about 12:00 o'clock.

Figure 14:
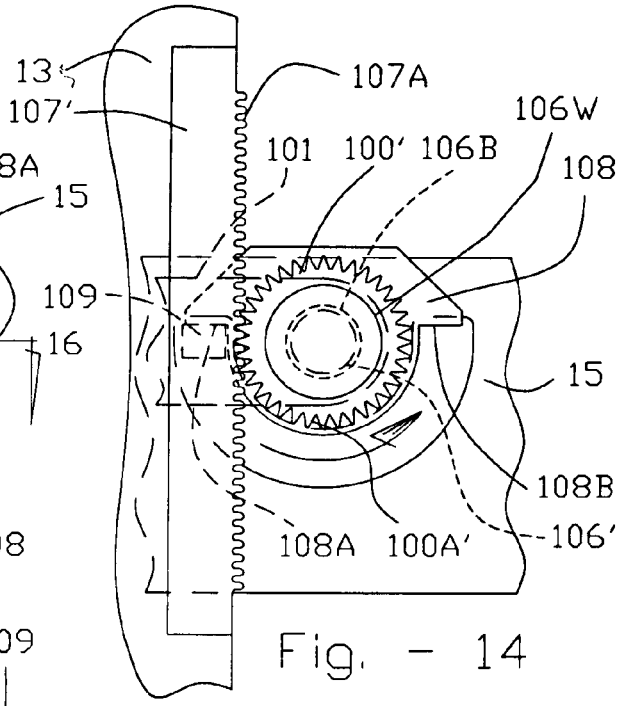

FIG. 14 is a plan view taken as along arrow "A" of FIG. 6 of the rack driver, progress rack and progress gear embodiment of FIG. 13. Position is about 3:00 o'clock.

Figure 15:
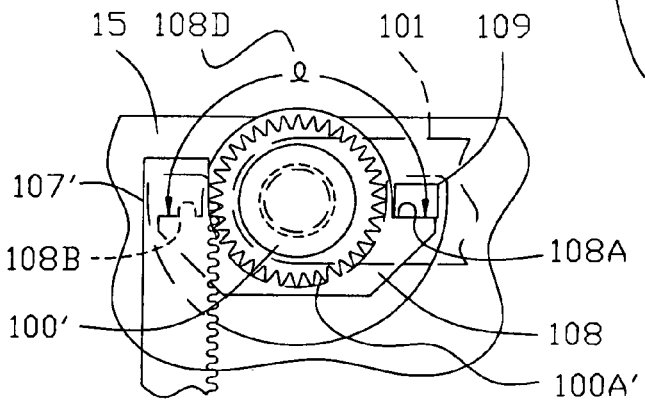

FIG. 15 is a plan view taken as along arrow "A" of FIG. 6 of the rack driver, progress rack and progress gear embodiment of FIG. 13. Position is about 6:00 o'clock.

Figure 16:
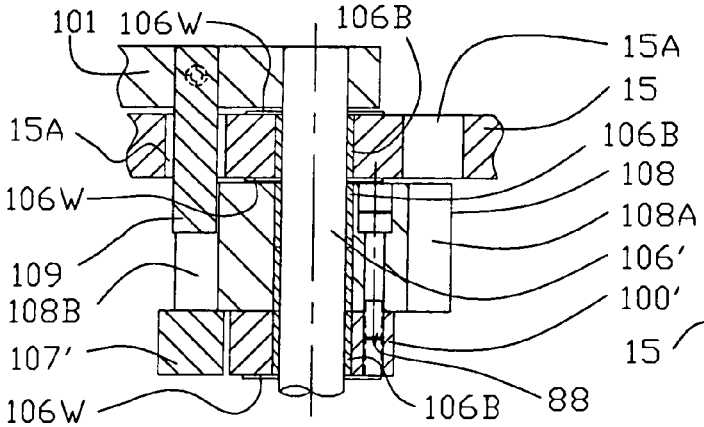

FIG. 16 is a section view taken along 16-16 of FIG. 13 of the rack driver, progress rack and progress gear embodiment of FIG. 13.

Figure 17:
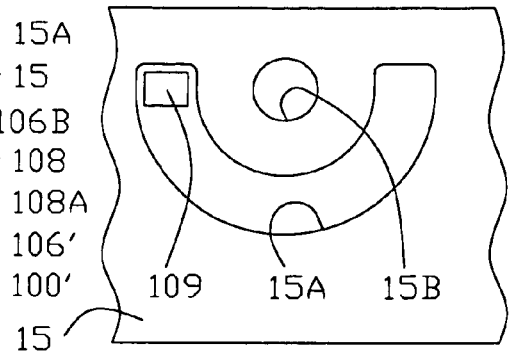

FIG. 17 is an elevation view of the inner base retainer with access channel and dog in the rack driver, rack driver and progress gear embodiment of FIG. 13.

Figure 18:
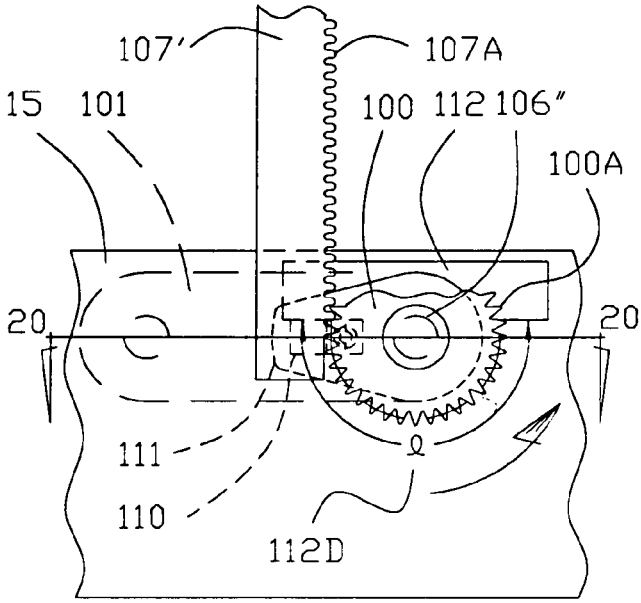

FIG. 18 is a plan view taken as along arrow "A" of FIG. 6 of another embodiment of a rack driver, progress rack and progress gear otherwise employable in the movement device of FIGS. 4 and 9. A modular progress rack, stationary with respect to the rack driver, is illustrated. The cycle position is about 12:00 o'clock.

Figure 19:
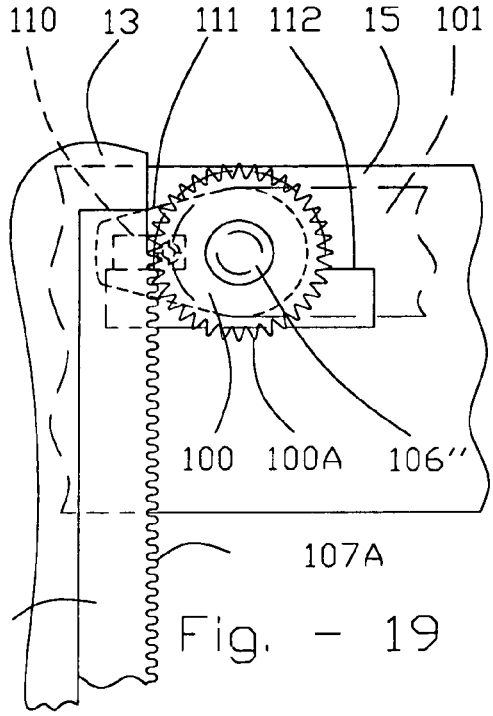

FIG. 19 is a plan view taken as along arrow "A" of FIG. 6 of the rack driver, progress rack and progress gear embodiment of FIG. 18. Position is about 6:00 o'clock.

Figure 20:
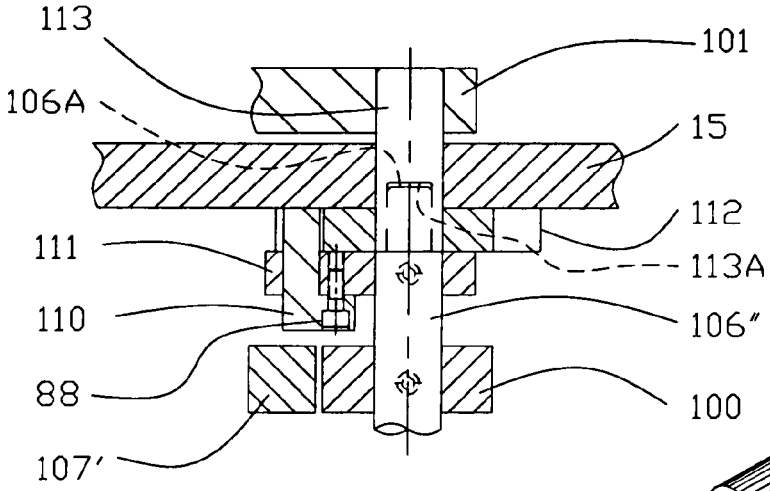

FIG. 20 is a section view taken along 20-20 of FIG. 18 of the rack driver, progress rack and progress gear embodiment of FIG. 18.

Figure 21:
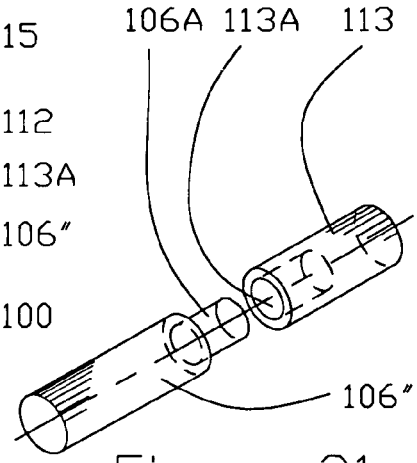

FIG. 21 is an exploded perspective plan view of primary and secondary portions of the progress shaft in the rack driver, progress rack and progress gear embodiment found in FIG. 18.

Figure 22:
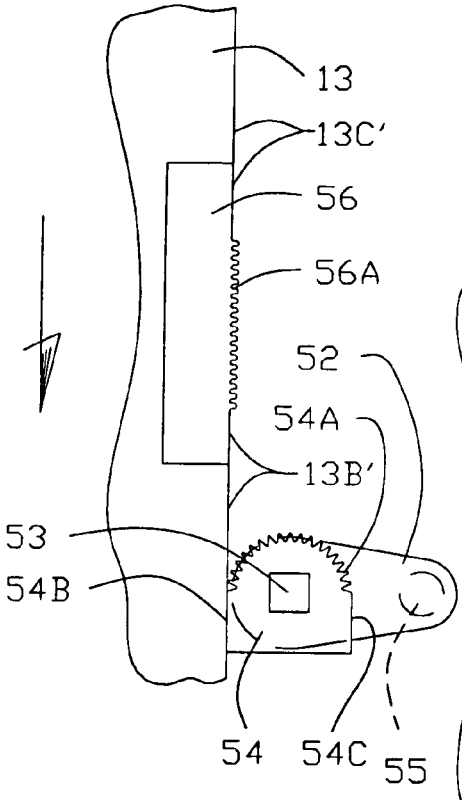

FIG. 22 is a plan view taken along arrow "B" of FIG. 6 of a rack driver, modular, stationary drive and elevation rack gear, and drive and elevation pinion gear as in the movement device of FIGS. 4 and 9. The cycle position is about 12:00 o'clock.

Figure 23:
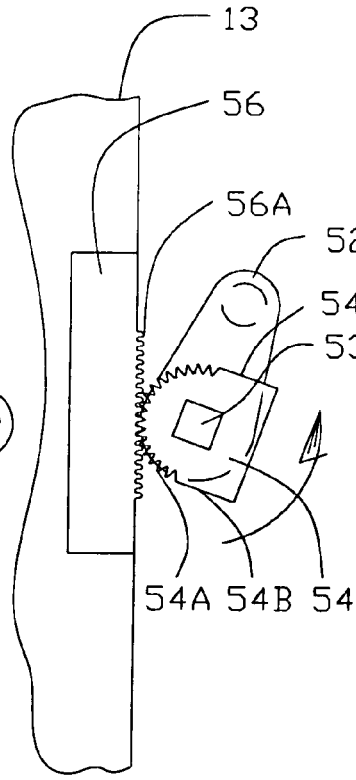

FIG. 23 is a plan view taken along arrow "B" of FIG. 6 of a rack driver and drive and elevation rack and pinion gears FIG. 22. The position is about 3:00 o'clock.

Figure 24:
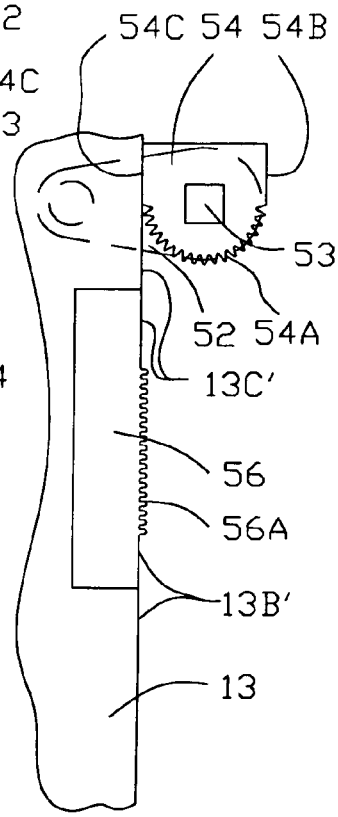

FIG. 24 is a plan view taken along arrow "B" of FIG. 6 of a rack driver and drive and elevation rack and pinion gears of FIG. 22. The position is about 6:00 o'clock.

Figures 25, 26, 27, 28, 29, 30:
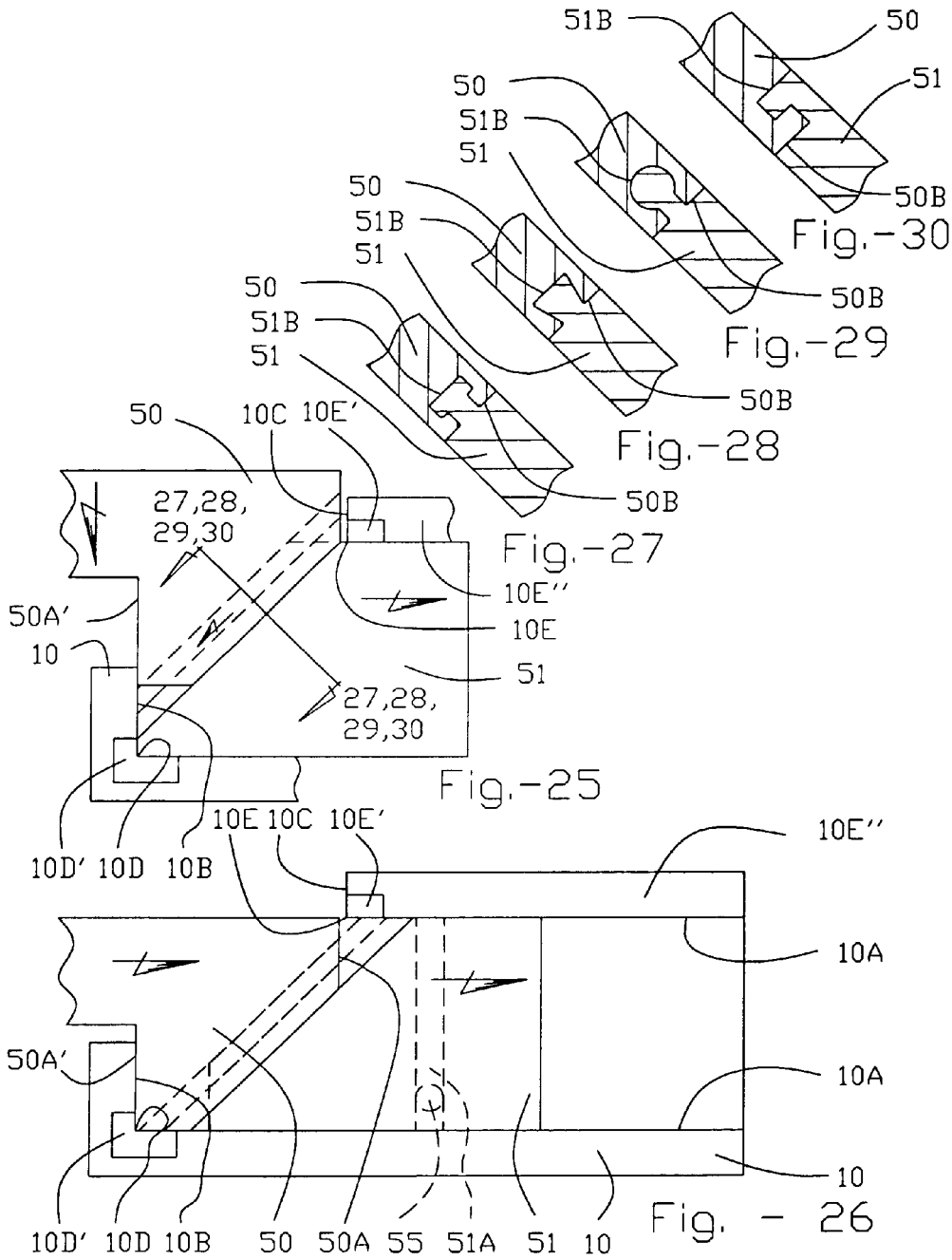

FIG. 25 is a plan view taken along arrow "C" of FIG. 6 of a drive and elevation transfer mount with associated parts as in the movement device of FIG. 4. The cycle position is about 12:00 o'clock.

FIG. 26 is a plan view taken along arrow "C" of FIG. 6 of the drive and elevation transfer mount and associated parts of FIG. 25. The position is about 3:00 o'clock.

FIGS. 27-30 are section views of some mount interfacing embodiments for the mount and parts of FIG. 25, each taken along 27, 28, 29, 30-27, 28, 29, 30 of FIG. 25.

FIG. 31 is a plan view taken as along arrow "C" of FIG. 6 of another embodiment of a drive and elevation transfer mount with associated parts as for the movement device of FIG. 4. The cycle position is about 12:00 o'clock.

FIG. 32 is a plan view taken along arrow "C" of FIG. 6 of the drive and elevation transfer mount and associated parts of FIG. 31. The position is about 3:00 o'clock.

Figures 33, 36:
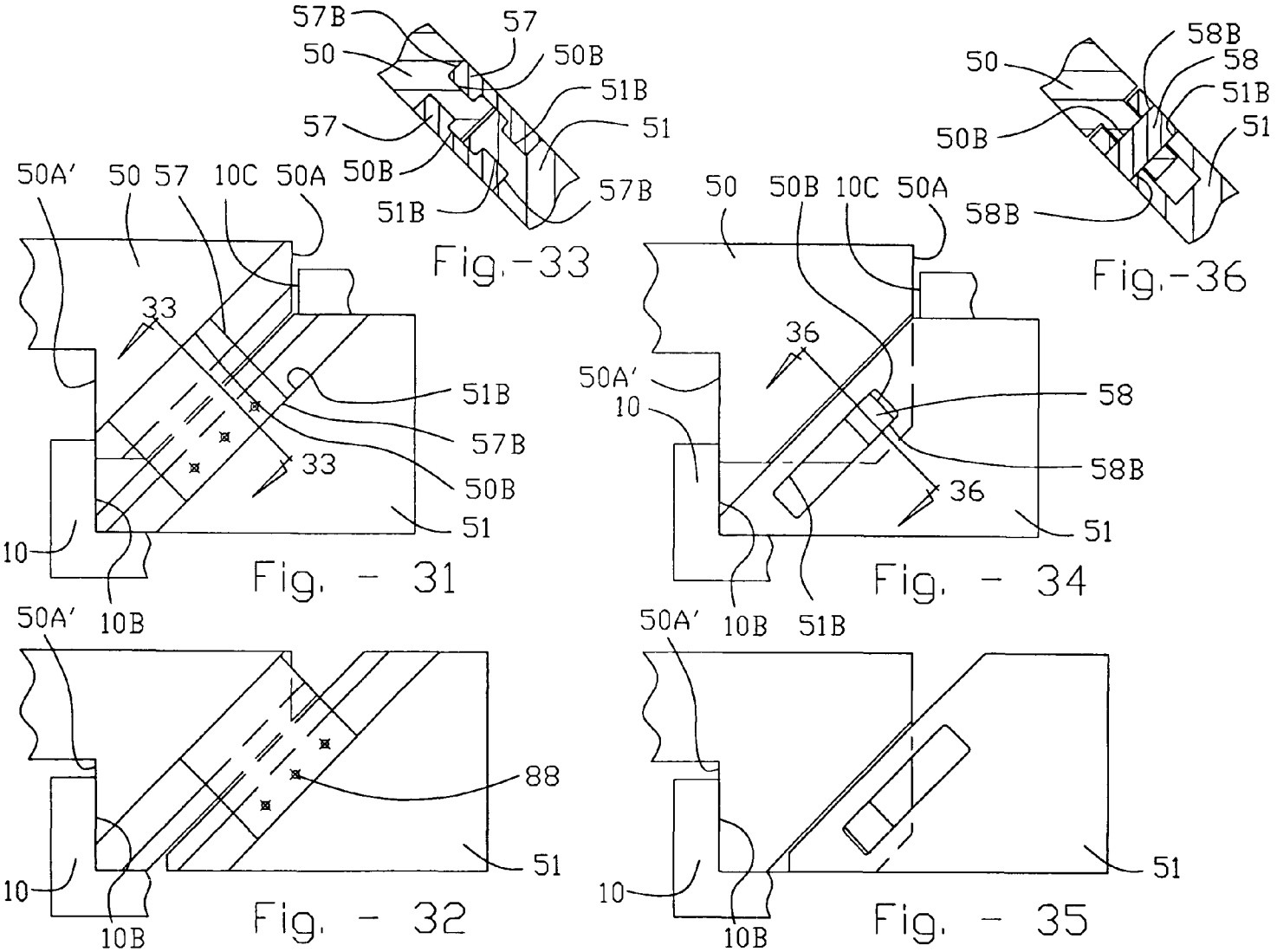

FIG. 33 is a section view taken along 33-33 of FIG. 31 of a mount interface for the drive and transfer mount and associated parts of FIG. 31.

FIG. 34 is a plan view taken as along arrow "C" of FIG. 6 of another embodiment of a drive and elevation transfer mount with associated parts as for the movement device of FIG. 4. The cycle position is about 12:00 o'clock.

FIG. 35 is a plan view taken along arrow "C" of FIG. 6 of the drive and elevation transfer mount and associated parts of FIG. 34. The position is about 3:00 o'clock.

FIG. 36 is a section view taken along 36-36 of FIG. 34 of a mount interface for the drive and elevation transfer mount and associated parts of FIG. 34.

Figures 37, 38, 39, 40, 41, 42:
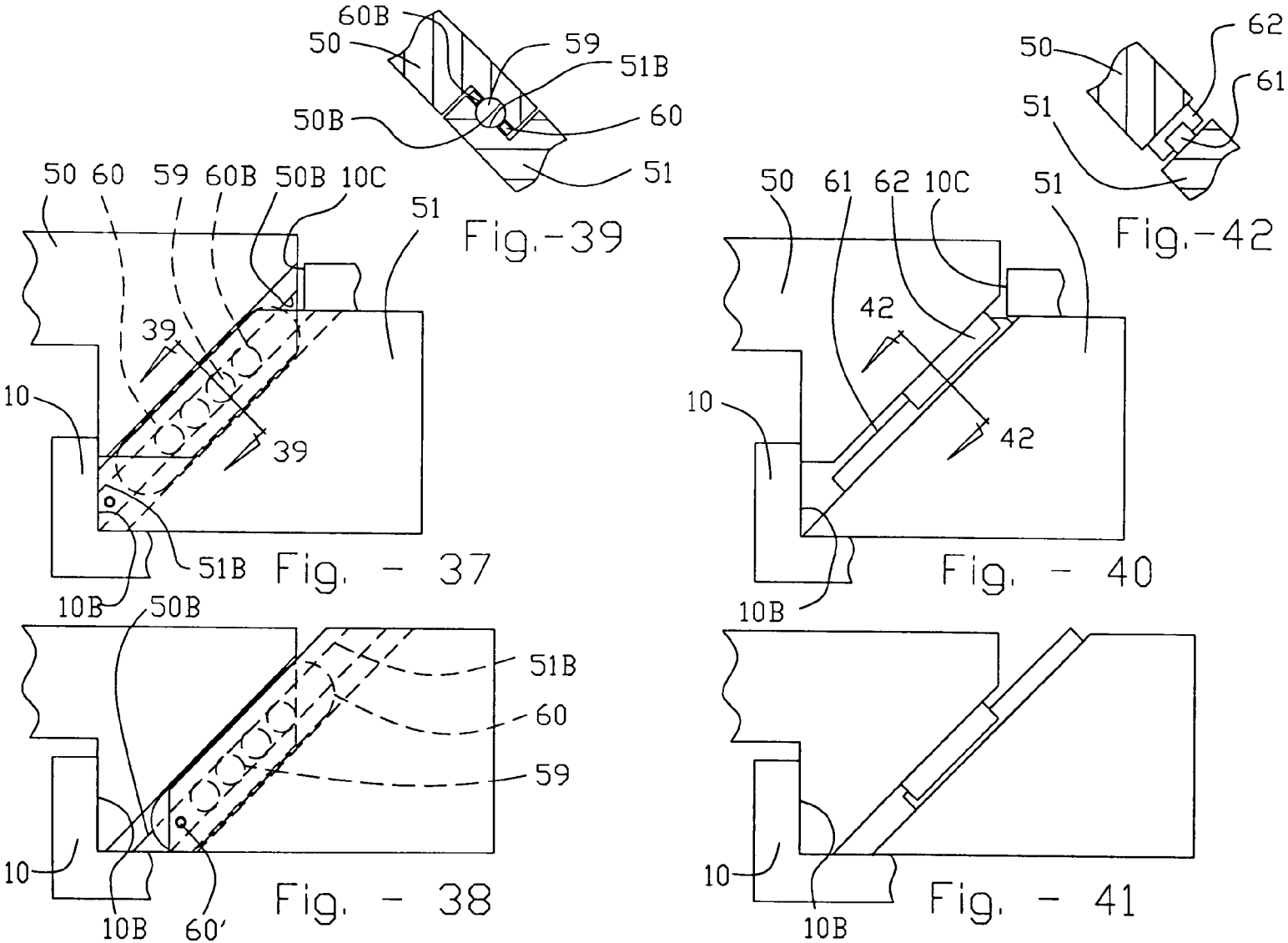

FIG. 37 is a plan view taken as along arrow "C" of FIG. 6 of another embodiment of a drive and elevation transfer mount with associated parts as for the movement device of FIG. 4. The cycle position is about 12:00 o'clock.

FIG. 38 is a plan view taken along arrow "C" of FIG. 6 of the drive and elevation transfer mount and associated parts of FIG. 37. The position is about 3:00 o'clock.

FIG. 39 is a section view taken along 39-39 of FIG. 37 of a mount interface for the drive and elevation transfer mount and associated parts of FIG. 37.

FIG. 40 is a plan view taken as along arrow "C" of FIG. 6 of another embodiment of a drive and elevation transfer mount with associated parts as for the movement device of FIG. 4. The cycle position is about 12:00 o'clock.

FIG. 41 is a plan view taken along arrow "C" of FIG. 6 of the drive and elevation transfer mount and associated parts of FIG. 40. The position is about 3:00 o'clock.

FIG. 42 is a section view taken along 42-42 of FIG. 40 of a mount interface for the drive and elevation transfer mount and associated parts of FIG. 40.

Figure 43:
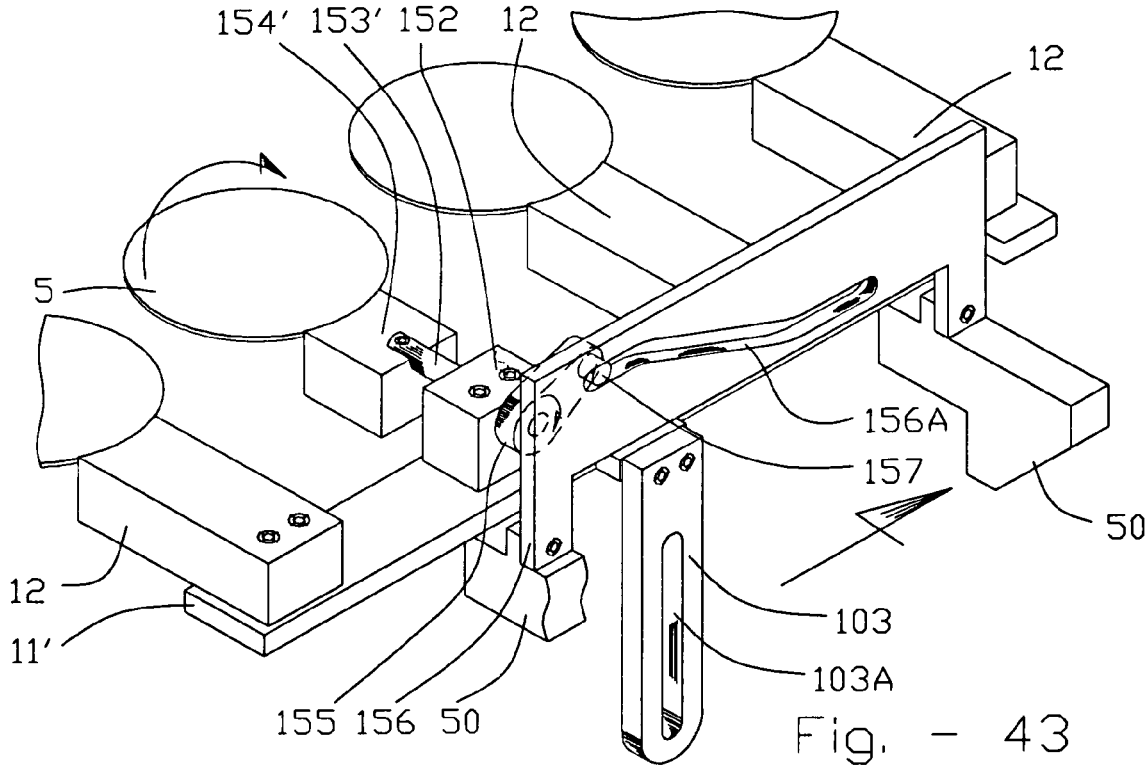

FIG. 43 is a perspective plan view of a part for a movement device of FIG. 4, showing a cam embodiment to provide rotation. Cycle position is about 12:00 o'clock.

Figure 44:
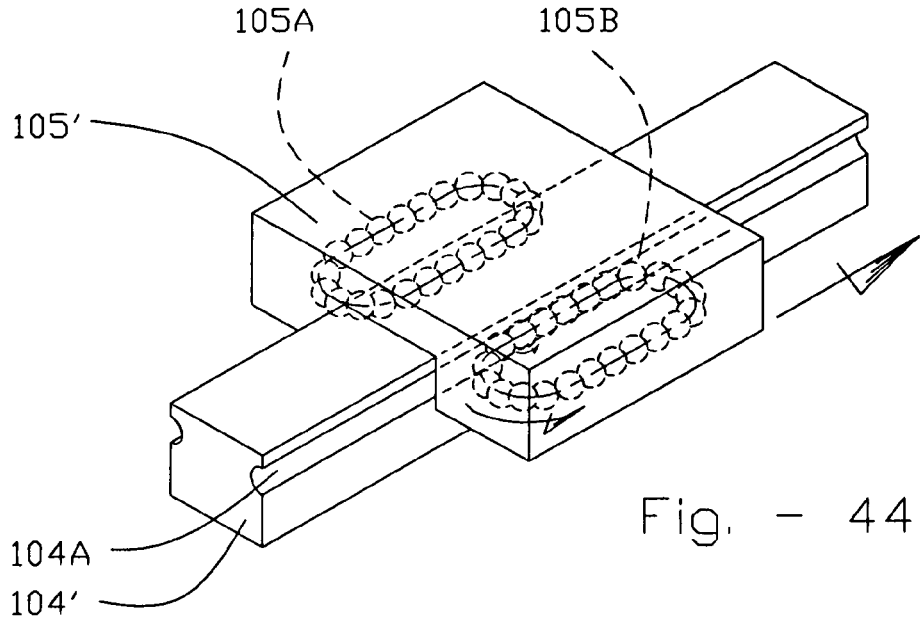

FIG. 44 is an illustration of a linear bearing, which may be employed herein.

Figure 45:
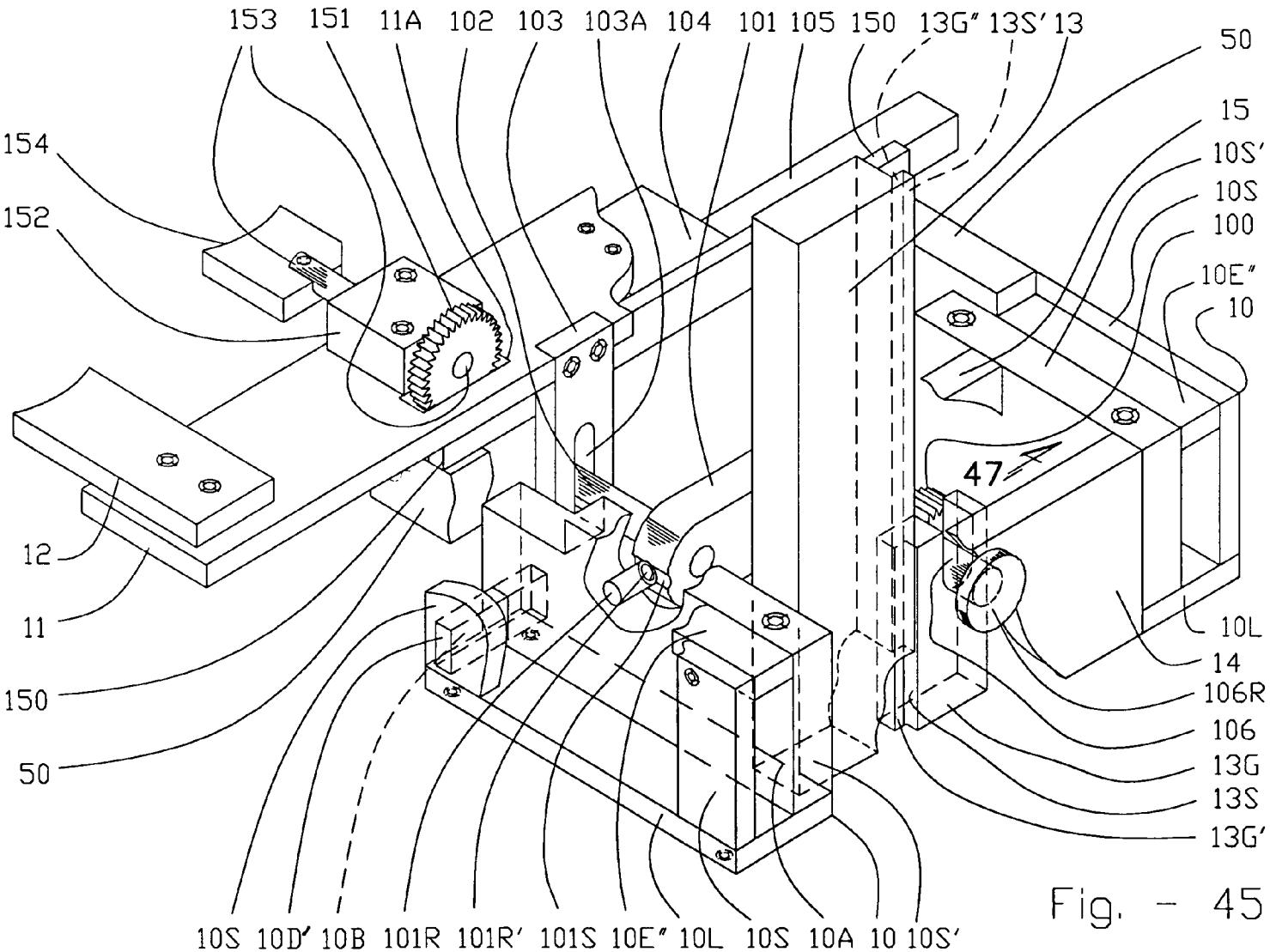

FIG. 45 is a perspective plan view with portions in section of another embodiment of one of a pair of movement devices for transferring parts with respect to a die. The cycle position is about 12:00 o'clock. Compare, FIGS. 2-4.

Figure 46:
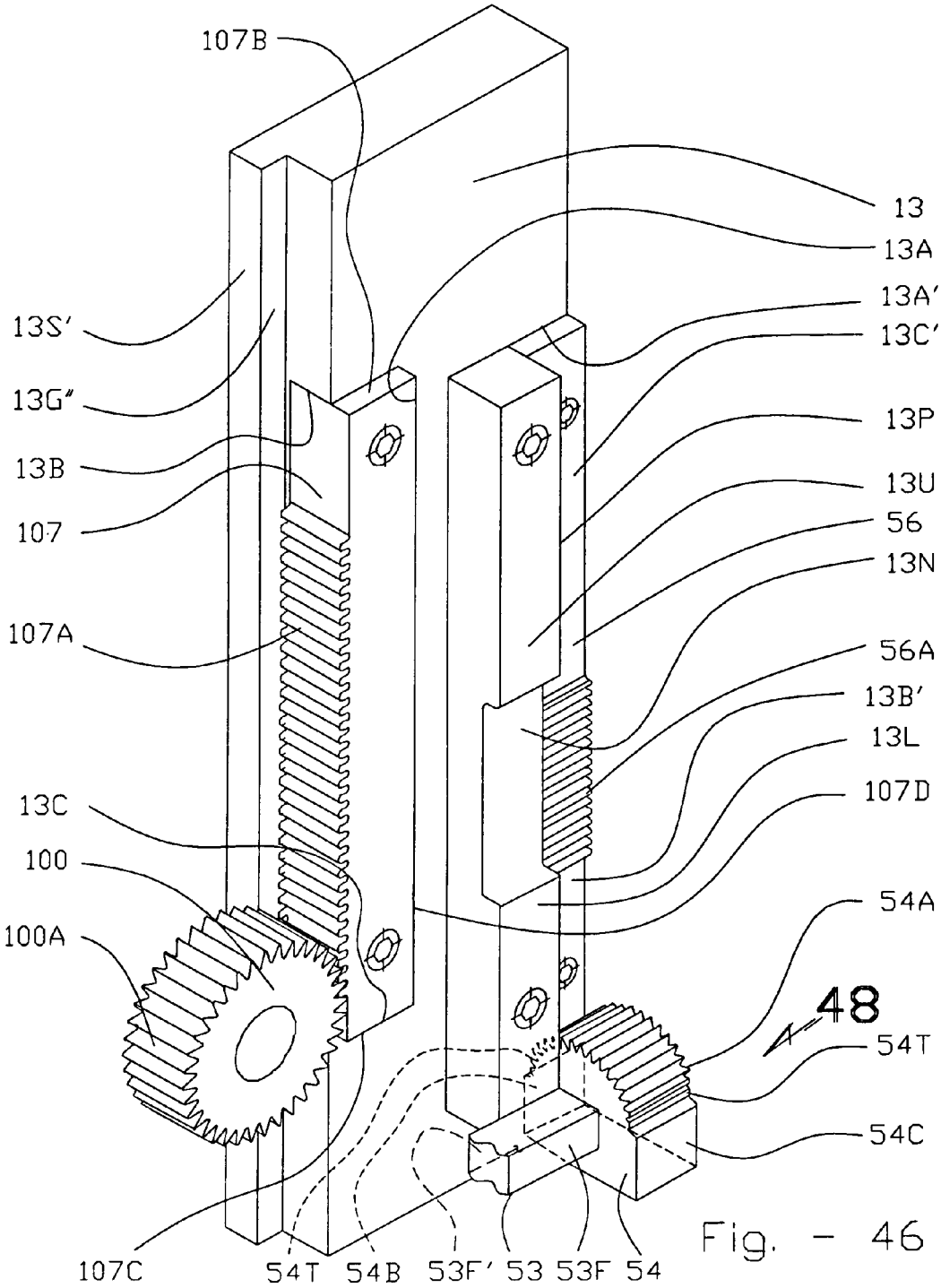

FIG. 46 is a perspective plan view of another embodiment of a rack driver and some associated parts and gears in the movement device of FIG. 45. The cycle position is about 12:00 o'clock.

Figure 47:
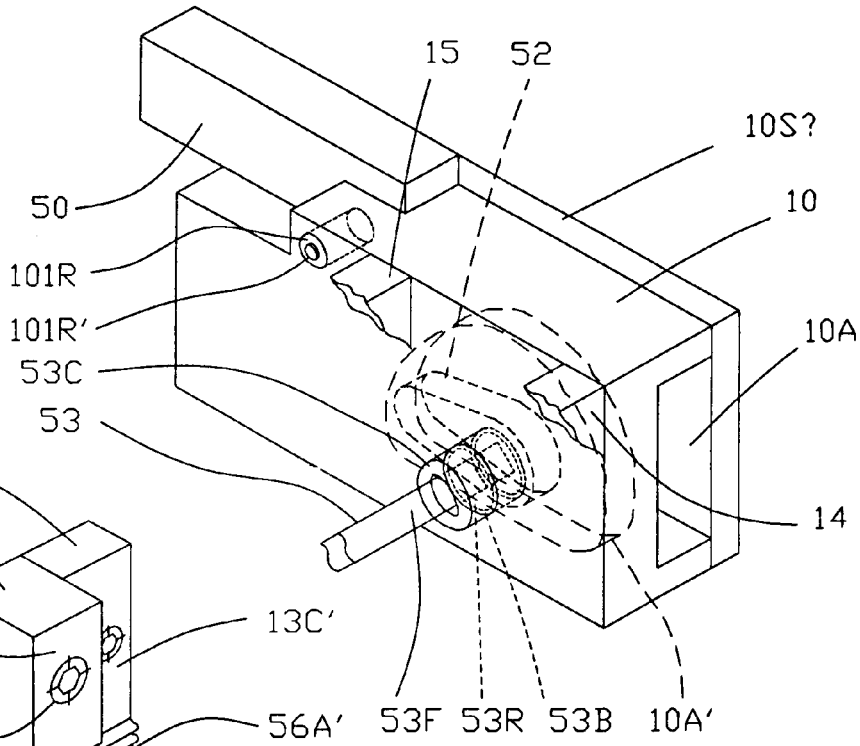

FIG. 47 is a detailed perspective plan view of part of the base including guide channel within the movement device of FIG. 45 taken along arrow 47 in FIG. 45. The cycle position is about 12:00 o'clock.

Figure 48:
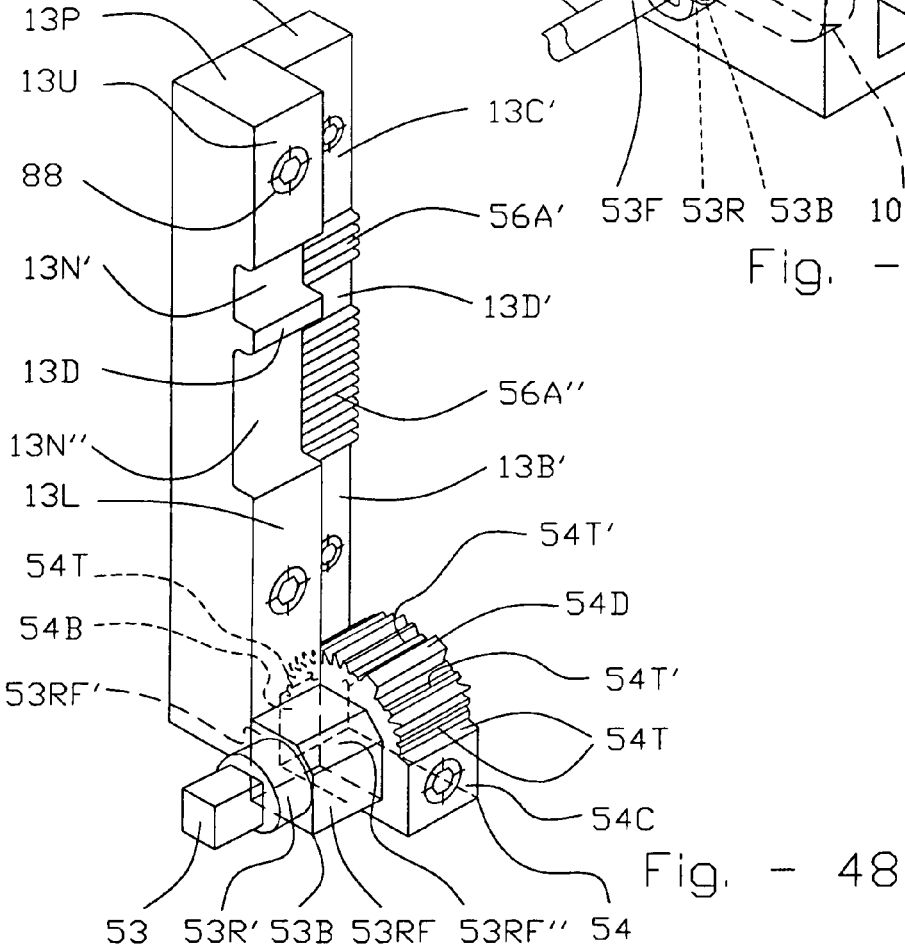

FIG. 48 is a detailed view of part of another embodiment of a drive and elevation gear module set for a rack driver, with some associated parts and gears, which can be employed in the rack driver of FIG. 46. The cycle position is about 12:00 o'clock.

Figure 2:
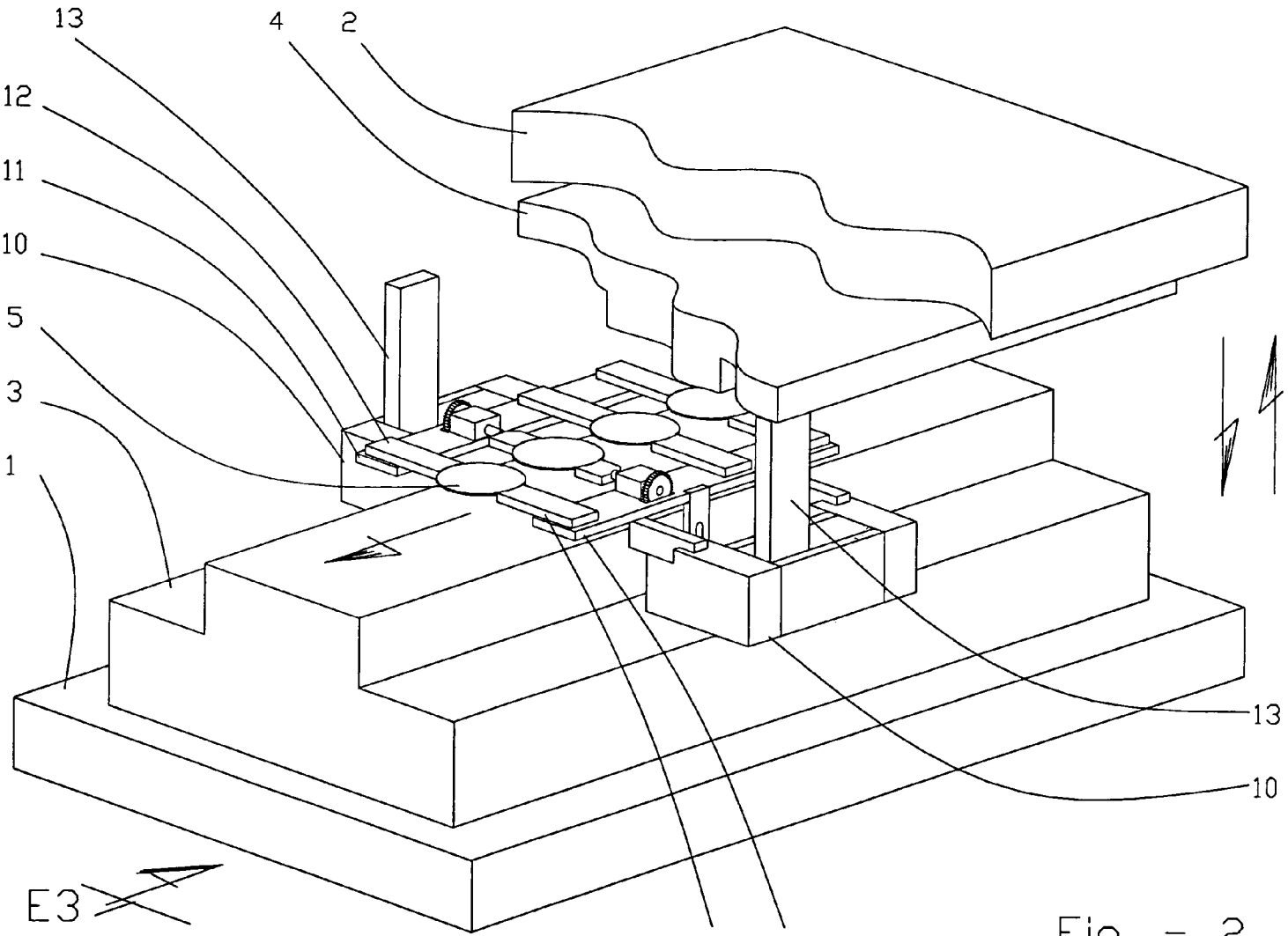
Figure 49C:
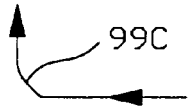
Figure 49:
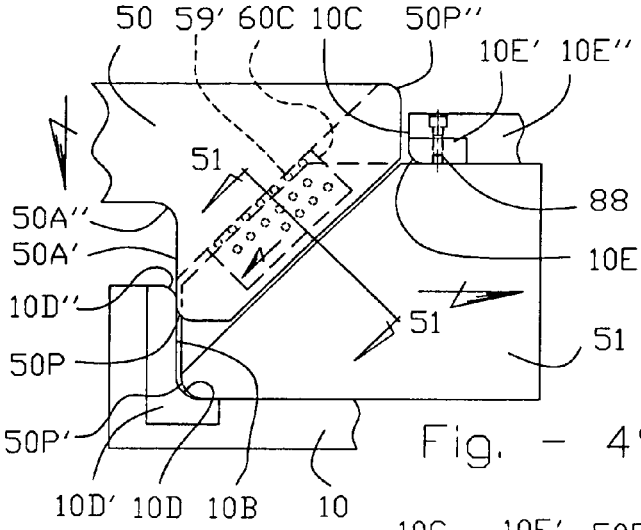
Figure 49B:
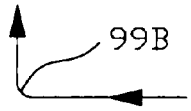
Figure 49A:
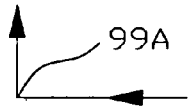

FIGS. 49, 49A, 49B and 49C represent further embodiments and illustrations hereof, which are a side plan view taken along arrow "C" in FIG. 6 of another embodiment of a drive and elevation transfer mount with assorted parts as can be employed or found in a movement device as of FIGS. 4 and 45, with the cycle position at about 12:00 o'clock (FIG. 49). Drive and elevation overlap motion profile paths, which an end effector would ultimately follow, such as taken with reference to arrow E3 in FIG. 2 show a square overlap profile, i.e., no overlap (FIG. 49A); a rounded overlap profile (FIG. 49B); and a multiple-curve overlap profile (FIG. 49C).

FIG. 50 is a plan view again taken along the arrow "C" in FIG. 6 of the drive and elevation transfer mount and associated parts of FIG. 49. Position is about 3:00 o'clock.

Figure 51:
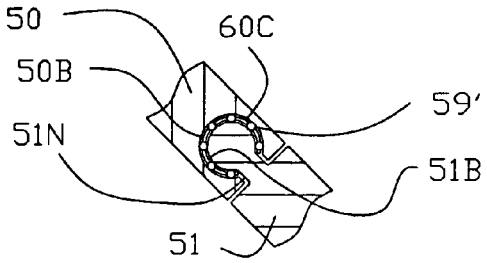

FIG. 51 is a sectional view of an embodiment of a mount interface for the drive and elevation transfer mount and associated parts of FIG. 49, which is taken along 51-51 of FIG. 49.

Figure 52:
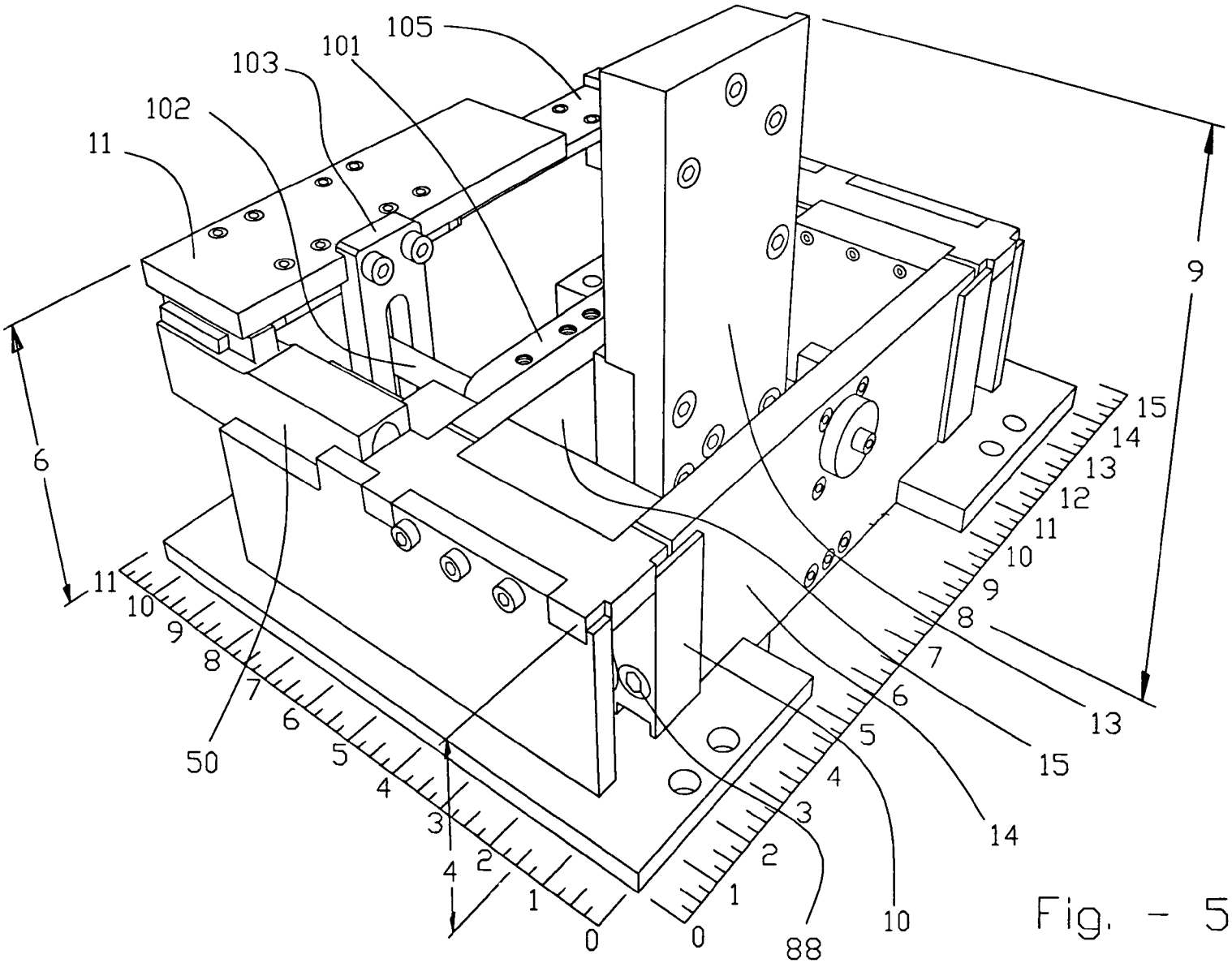

FIG. 52 is a perspective view of an assembled movement device for a die. Compare, FIGS. 4 and 45.

Figures 53, 53A:
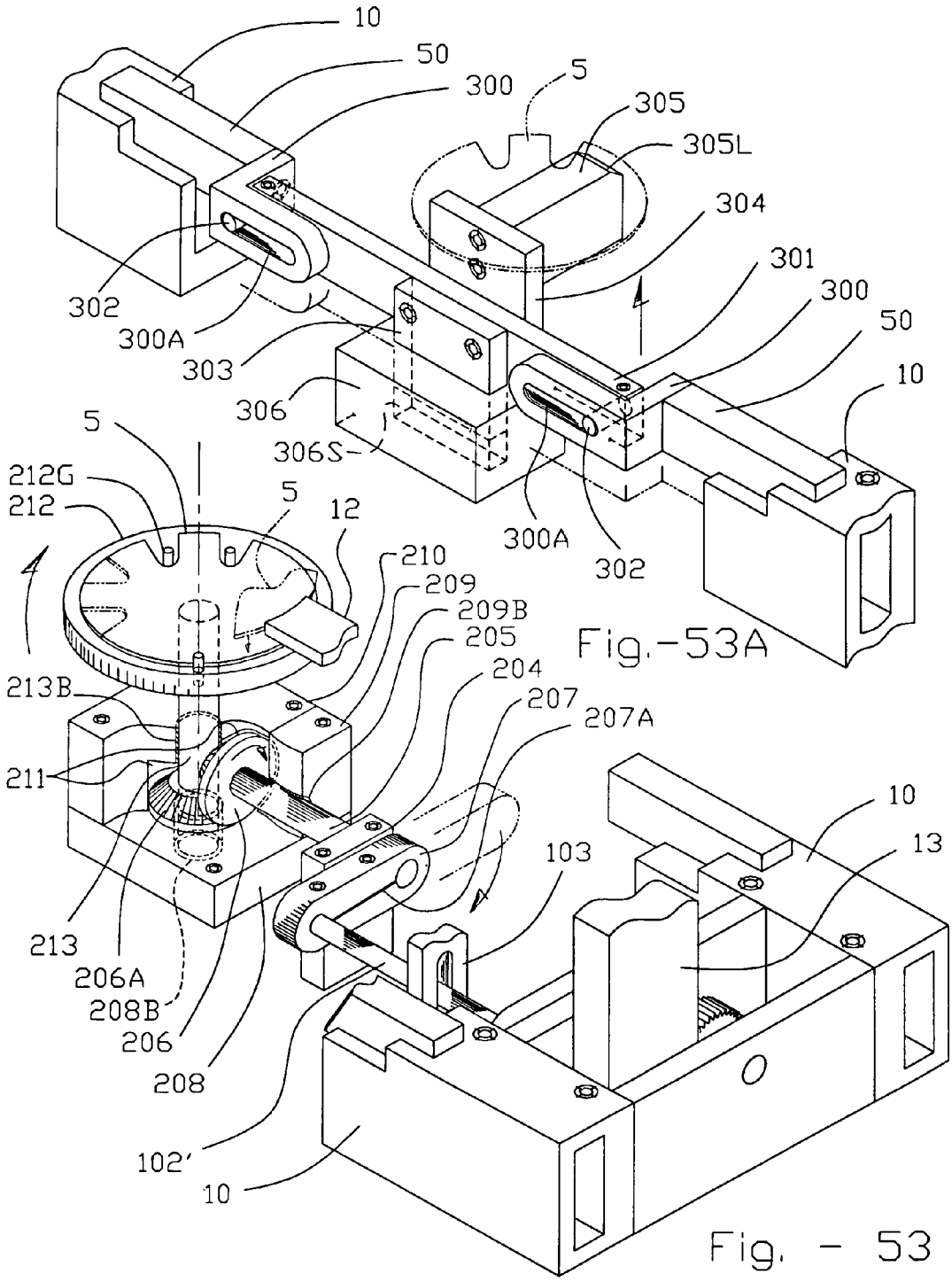
Figure 53C:
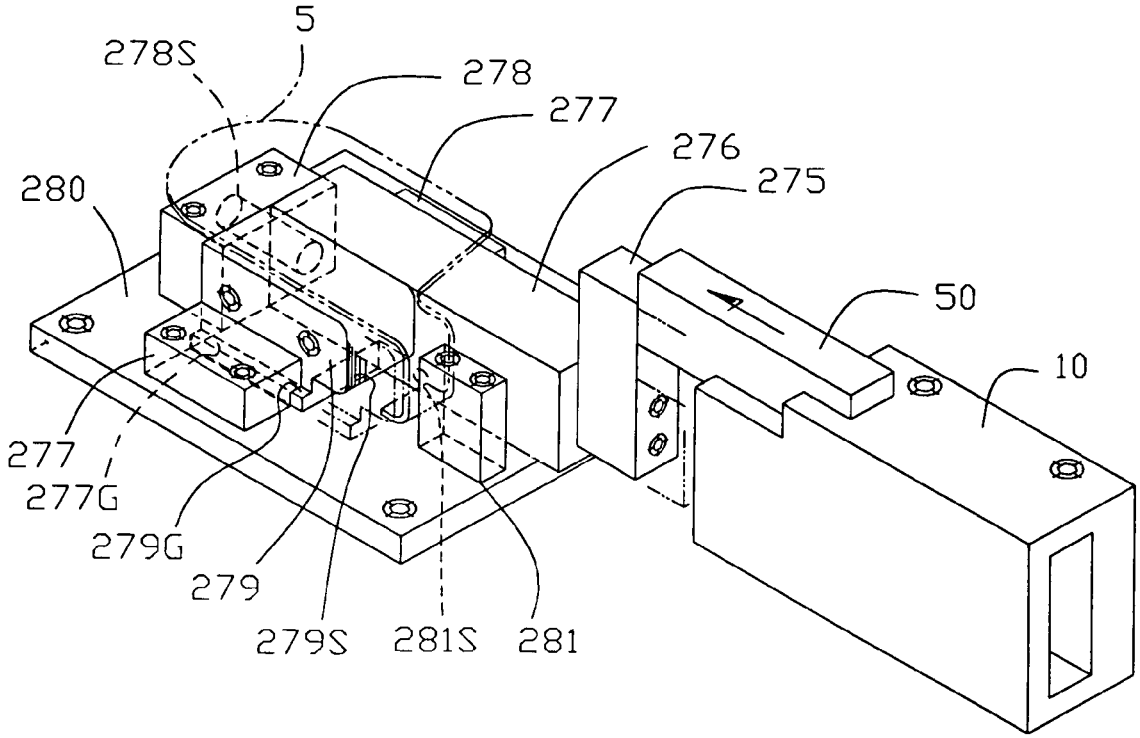

FIGS. 53, 53A, 53B and 53C are perspective plan views with portions in section of a movement device for a die having various assisting motion contrivances, as follows: a rotation contrivance with PTO from pitch motion, which rotates a work piece in or close to a work station in the die (FIG. 53); a work piece elevation contrivance with PTO from elevation, which happens to be from both of an opposing pair of coordinated elevation motion devices to provide elevation to a work piece or to a sensor, a light, an engraver, a sprayer and so forth and the like for testing, monitoring or working on a work piece (FIG. 53A); an elevation contrivance with PTO from drive motion, which may elevate a work piece, move a sensor, a light or a paint marker, apply oil, and so forth to work on or monitor a work piece in a die working station (FIG. 53B); and a locator slide contrivance with PTO from drive motion, which can be for providing access to an area about a work piece that would otherwise be unavailable at the die station (FIG. 53C).

Figure 54:
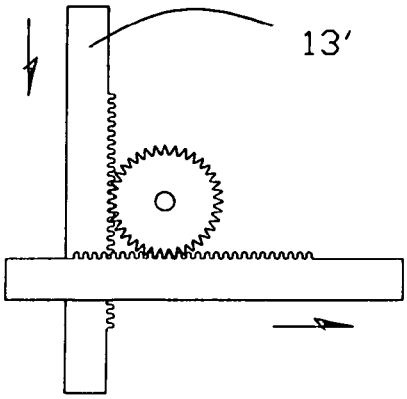
Figure 54A:
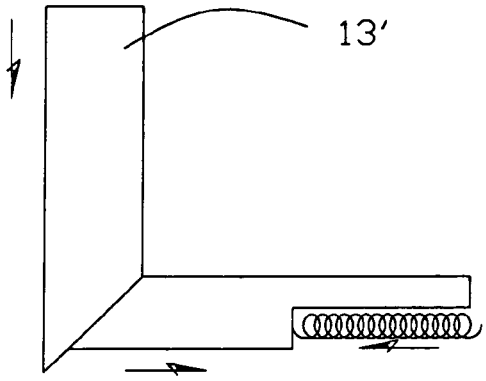
Figure 54B:
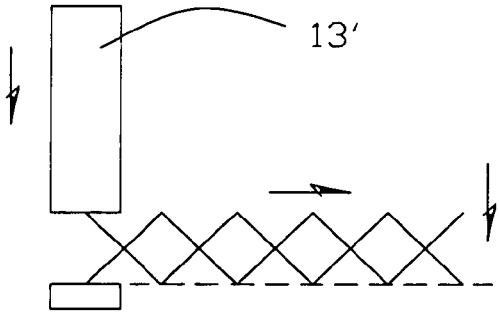
Figure 54C:
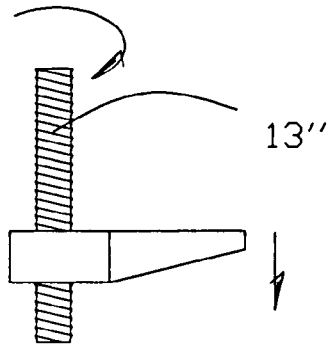
Figure 54D:
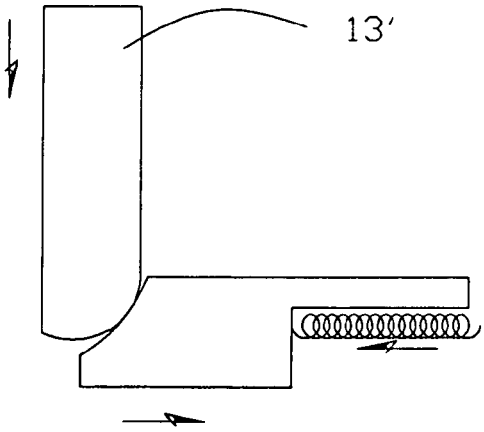

FIGS. 54, 54A, 54B, 54C and 54D depict illustrative embodiments, which may be employed in an embodiment of the present movement device for a die, as follows: racks interacting with a planetary gear as for a drive motion (FIG. 54); flat plane wedges with a return spring as for a drive motion (FIG. 54A); a scissors arm as for a drive and elevation motion (FIG. 54B); a ball screw as for an elevation motion (FIG. 54C); and a parabolic wedge with a return spring as for a drive motion (FIG. 54D).

The invention can be further understood by the detail set forth below, which may be read in view of the drawings. The same, as with the foregoing, is to be read in an illustrative and not necessarily limiting sense.

The present movement device embraces a mechanical converter, which converts slave motion in a first direction into a drive motion in a second direction different from the first direction, and in certain cases a pitch motion in a third direction different from the first and second directions. Examples of the mechanical converter may include devices with rack and pinion parts; lever(s); ball screw(s); and/or wedge(s). Such a mechanical converter for converting the first motion into the second and third motions, however, may be such that it is not a plate or rotating cam. A barrel cam can be considered a form of a rotating cam. The mechanical converter is mechanical in nature. The slave motion, however, can be provided with electrical force or through electronic devices and/or provided through application of any suitable mechanical, hydraulic, pneumatic, gravitational, magnetic, manual or other force; and any suitable control of the force may be employed as may be desired or necessary.

The first direction, i.e., that of the slave motion, may be considered to go along or parallel to the z-axis in a set of Cartesian coordinates, which have x-, y- and z-axes. It may go "up" and "down" in the direction of the z-axis to provide a stroke cycle.

The second direction, i.e., that of the drive motion, differs from the first direction, and may be considered in relation to the z-axis of the Cartesian coordinate system to go along or parallel to, or at least have a vector component of, the y-axis of the Cartesian coordinate system. Generally, this drive motion initially goes "in" towards the die in a die press cycle, which initial motion conventionally is considered to be the first, or first stroke return, motion in the cycle after a period of no motion at the bottom of the stroke where the part is worked on by the die. Typically, too, drive motion ultimately goes "out" away from the die later in the cycle before the period of no motion at the bottom of the stroke. Thus, the initial drive motion may go in toward the origin or z-axis along the y-axis, with the ultimate drive motion going out away from the origin or z-axis along the y-axis in a direction opposite to that of the initial drive motion.

The third direction, i.e., that of the progress (pitch) motion, differs from the first and second directions, and may be considered in relation to the z-axis of the Cartesian coordinate system to go along or parallel to, or at least have a vector component of, the x-axis of the Cartesian coordinate system. Generally, this pitch motion, although it goes back and forth, is such that the parts move only in one direction, "forward," along the line of production in the die press cycle, which motion conventionally is considered to occur subsequent to the initial drive motion. If elevation motion is provided, the pitch motion oftentimes follows the elevation motion of the die cycle. The pitch motion may go along the x-axis.

Additional motion(s) in a fourth or fifth or more direction (s) may be provided. A mechanical converter for these additional motion(s), although such may be provided through a plate or rotating cam, may be provided with a mechanical converter that is not a plate or rotating cam, examples of which, as before, may include devices with rack and pinion parts; lever(s); ball screw(s); and/or wedge(s). The mechanical converter for the motion in the fourth direction, however, notably may be found more so as such a converter that is not a plate or rotating cam. Nonetheless, the additional motion(s) may be provided non-mechanically such as through employment of direct electrical, magnetic, electromagnetic, hydraulic, pneumatic, gravity and so forth type force(s) to effectuate the additional motion(s) with or without reference to the slave motion in the first direction.

The fourth direction, i.e., that of elevation motion, differs from the second and third directions but includes a vector component along or opposite to the first direction, and may be considered to go along or parallel to, or at least have a vector component of, the z-axis of the Cartesian coordinate system. Generally, this elevation motion initially goes "up" from the die in a die press cycle, which initial motion conventionally is considered to be the second motion that occurs between the drive "in" motion and the pitch "forward" motion in the cycle. Typically, too, elevation motion ultimately goes "down" to the die later in the cycle before the drive "out" motion and subsequent to a period of no motion at the top of the stroke. Thus, the initial elevation motion may be considered to go in up from the origin or x- and y-axes along the z-axis, with the ultimate elevation motion going down toward the origin or x- and y-axes along the z-axis in a direction opposite to that of the initial elevation motion. And so, the first and fourth directions may be the same, both running along the z-axis. In other words, the directions of the slave and elevation motions may be the same. Although the motion in the fourth direction can be from a mechanical converter that converts slave motion in a first direction into the elevation motion, if mechanical conversion is not employed, the elevation motion may lend itself to fluid-actuated motion such as from hydraulic or pneumatic actuation, from a linear or servo electric motor, or from a rotating electric motor, say, in association with a screw.

Additional motion(s) defined along direction(s) radial to the first, second, third and/or fourth direction(s) may be provided, which may, for example, be considered as fifth, sixth, seventh and eighth motions. Each of such motions may be considered to be a rotation about a respective axis defined by the direction of the slave motion, the drive motion, the pitch motion and/or the elevation motion, which, may be considered to be rotation(s) about the x-, y- and/or z-axes or about an axis that has components of two or more of the x-, y- and z-axes. Although the motion in the fifth and so on direction(s) can be from a mechanical converter that converts slave motion in a first direction into the rotation motion, with or without period(s) of no motion, if mechanical conversion is not employed, the rotation motion may lend itself to electric motor actuation such as from a rotating electric motor, or even a linear or servo electric motor or fluid-actuated motion such as from hydraulic or pneumatic actuation, say, which can drive a rack in association with a rotating pinion gear.

Assisting motion(s) can be provided in a form of a power take off (PTO) transfer system. For instance, one assisting motion, say, elevation, could be provided with PTO from a drive motion; another assisting motion, say, drive, could be provided with PTO from an elevation motion; and another assisting motion, say, rotation, could be provided with PTO from a pitch motion. An assisting motion generally helps manipulate a work piece while in a die station such as to assist in making it ready for operation by the die.

As mentioned previously, the basic motions are provided through any of various mechanical converters, and additional and/or assisting motion(s) may be provided as may be desired. For example, the slave motion may be provided so as to move a vertically oriented rack gear that is forced to move up and down through application of force. The rack gear may have upper and lower flats, i.e., surfaces without teeth, and its teeth set between the flats. It may have two or more different rack gear sets. The drive motion may be provided by a first pinion gear in communication with the rack gear to provide, say, clockwise then counter clockwise motion to the first pinion gear as the rack gear oscillates, say, up and down. The pitch motion may be provided by a second pinion gear in communication with the rack gear, with the second pinion gear having a surface area with teeth and another that is flat, which communicate respectively with the teeth and the other of the flats of the oscillating rack gear to respectively provide the pitch motion and another period of no motion in the die cycle. Transition gear teeth can be provided in the rack and/or pinion gear(s) so as to more effectively engage and disengage toothed and flat areas. The pitch and drive motions may be provided so that they are linearly related to the slave motion such as through employment of planetary gearing in communication with the drive rack gearing, i.e., first drive rack gearing, and a second rack gearing, say, perpendicular to the first drive rack gearing, a wedge having engagement along a straight line or plane and forced by the slave motion out and returned by a spring, a scissors arm, or a ball screw; or so that they are not linearly related to the slave motion such through employment of rotating actuating arm(s) or of a general wedge having engagement along a surface that is not a straight line or plane such as taken from a side view as, for example, a general wedge with a parabolic surface for engagement of the wedged member, which may be returned with a spring. The non-linearly related motions may be considered to have acceleration and deceleration components. Examples of the non-linearly related motions are a cycloid motion or a harmonic motion for pitch and/or drive motion(s) with respect to the slave motion such as can be provided through a rotating arm system. Additional motion(s) may be provided mechanically, and be slaved off the first motion or a subsequent motion. Thus, for example, elevation motion may be provided in conjunction with the drive motion. Rotation motion(s) may be drawn off such rack gear(s) and so forth. Assisting motion(s) may be provided as well.

The various motions are utilized to move parts into position to be worked on by the die to which the movement device is connected. One or more movement device(s) can be associated with and connected to the same die. The slave motion of each of the movement devices in a plural arrangement with the same die may come from the same source or from different sources. The combination is used through initiating motion of the die and the slave motion. Simultaneously, a work piece is fed and operated upon.

The working components of the movement device such as the mechanical converter and its component parts can be housed in a housing. Fasteners or other features may be employed to secure the mechanical converter to the housing, and to the die.

Any suitable material may be employed to make the movement device. For instance, a suitable metal or metal alloy such as of or with aluminum, cobalt, copper, iron, magnesium, titanium, brass and/or steel, for example, hardened steel and/or coated aluminum, and/or a suitable plastic, plastic composite and/or ceramic may be employed. A high quality, hardened tool steel may be employed.

The movement device can be combined with the die, in general, by standard installation techniques, or by others, to include those such as disclosed hereby. For example, a progressive type die can have fastened to it an opposing pair or multiple opposing pairs of the movement devices or even one or more unpaired movement devices, each of which may be the same or different for mirror image or other movement and function, respectively, to a lower stationary die and/or a lower bolster and an upper movable die and/or an upper bolster.

Figure 1:
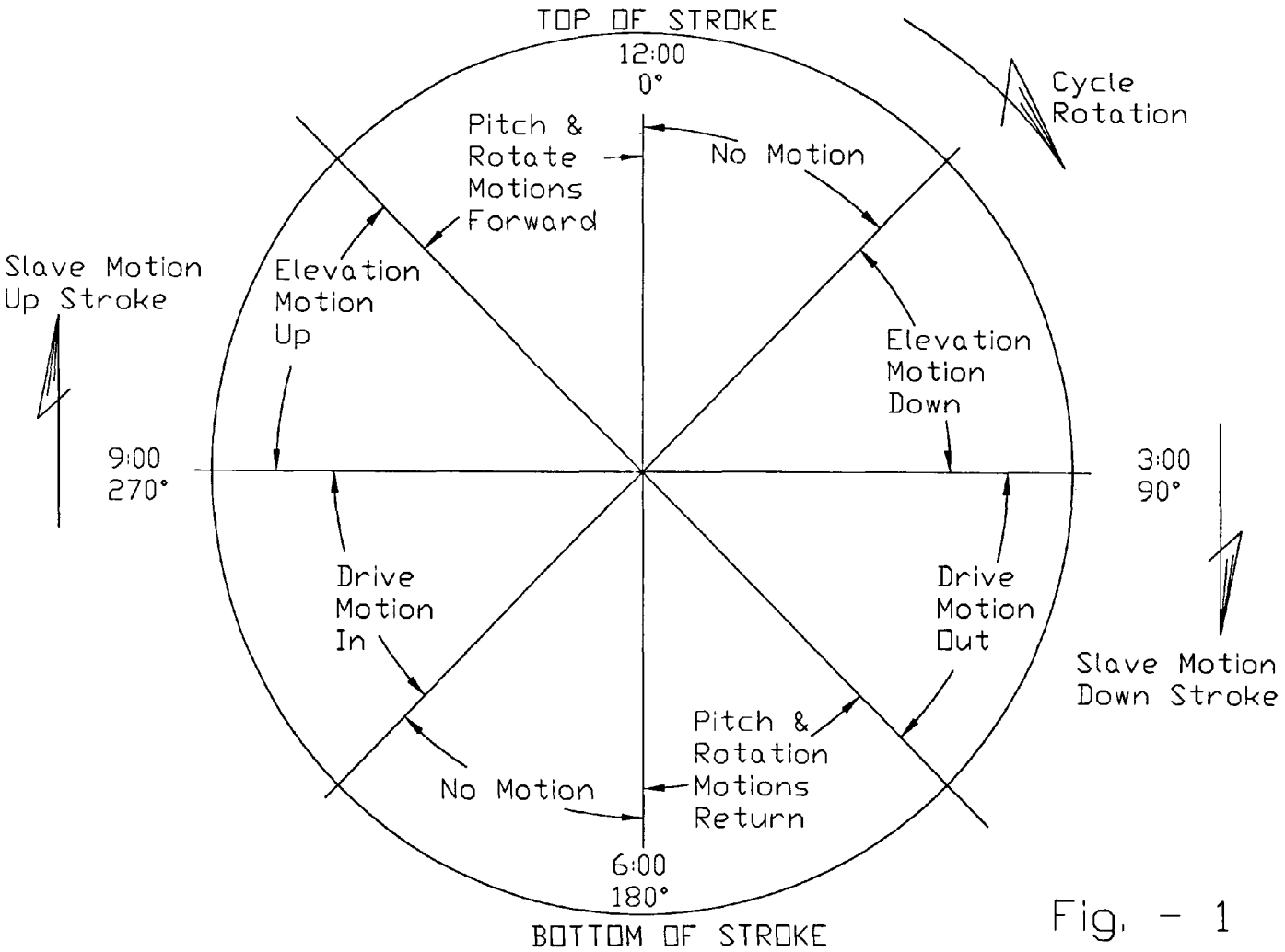
Figure 1A:
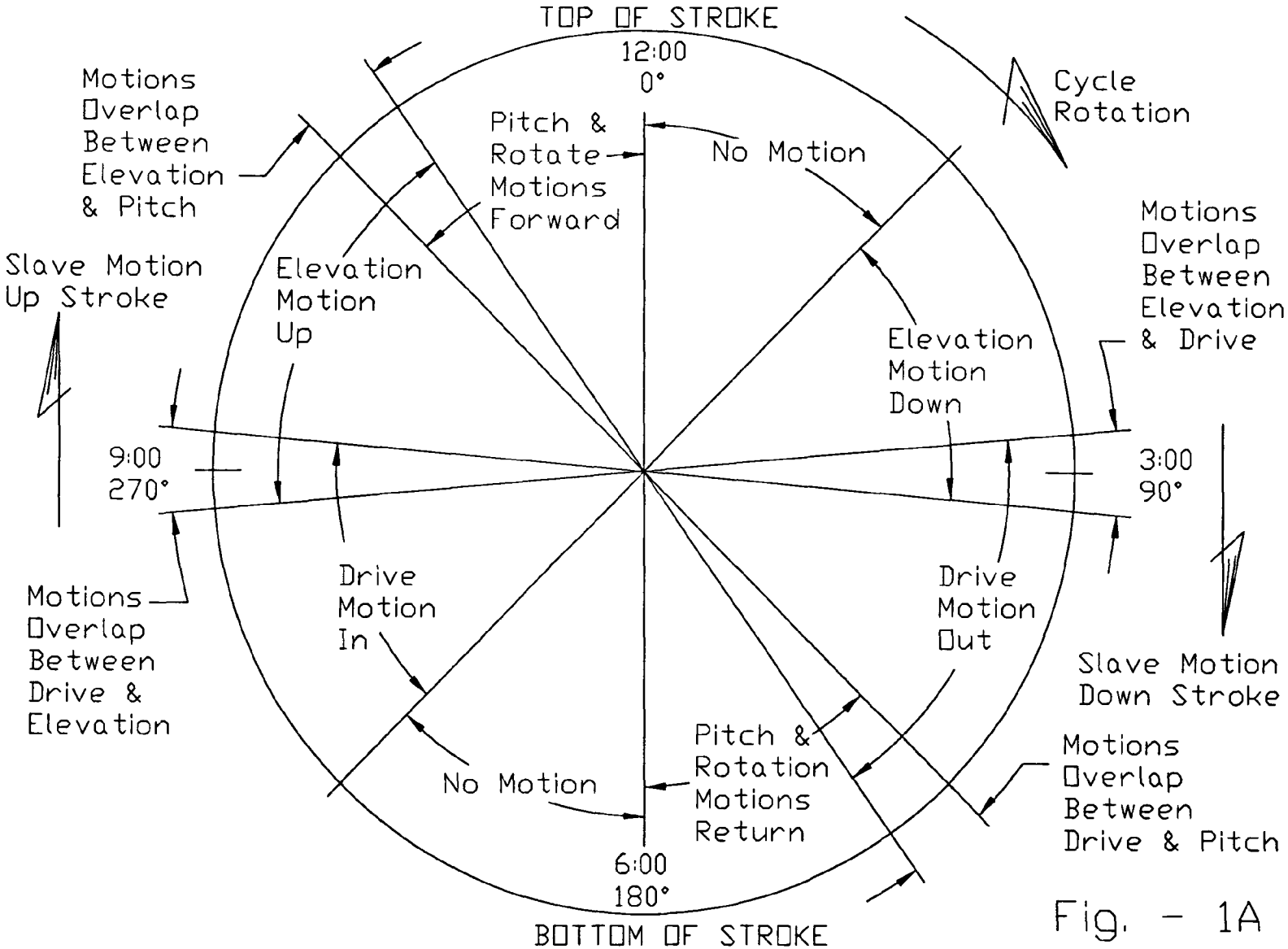
Figure 1B:
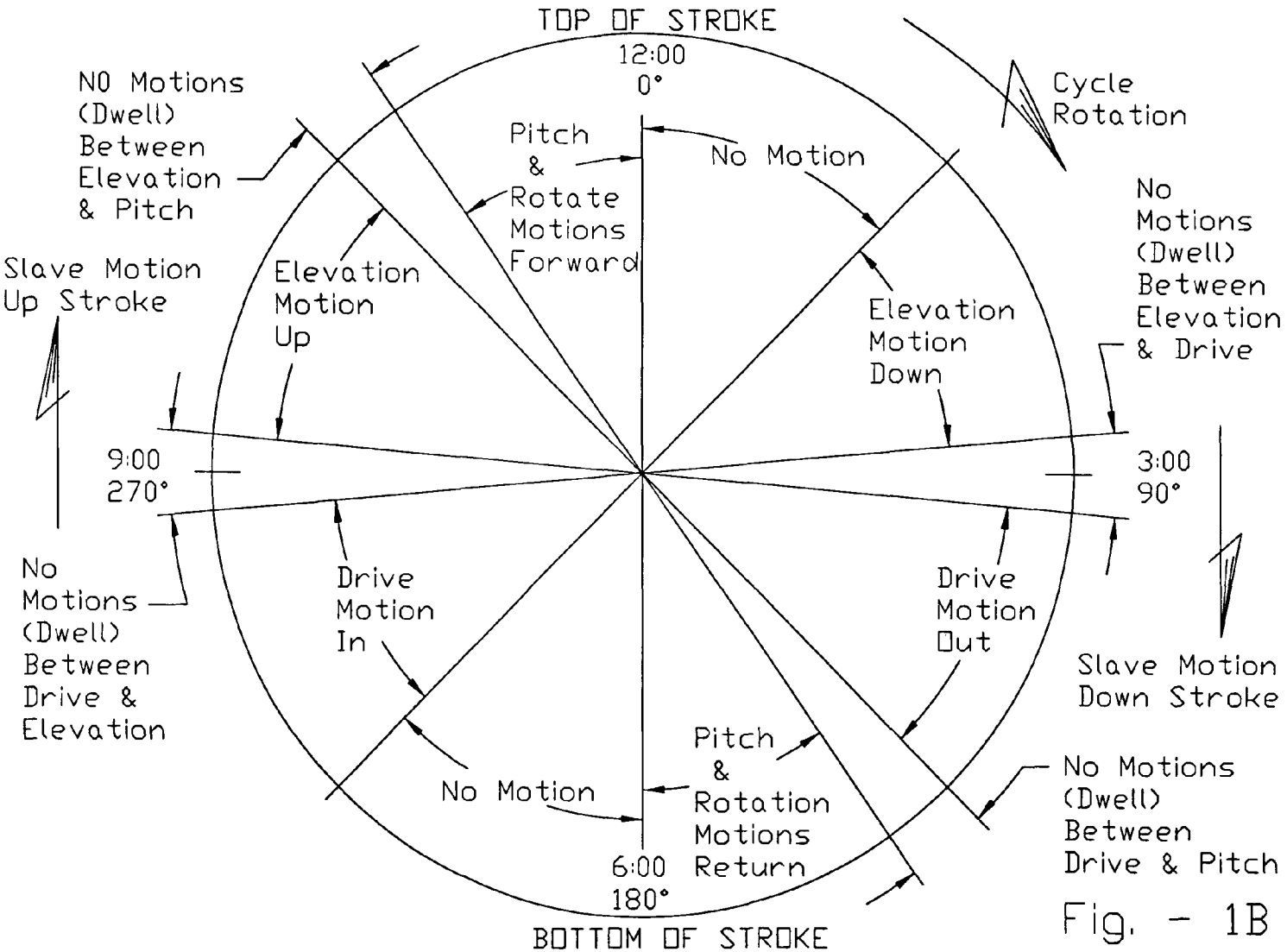

With reference to the drawings, beginning with FIGS. 1, 1A and 1B, each of the die cycles represents motion of a progressive type die having the movement device(s) installed. Top of stroke is represented as 12:00 o'clock and bottom at 6:00 o'clock, with successive motions in the cycle represented in clockwise fashion. This repeats for successive cycles until shutdown. These three cycles are provided for purposes of illustration, to which the present movement device movements can relate. Such cycle timing charts represent basic timing parameters, and are subject to change depending on the particular processing application at hand. For example, the elevation motion down illustrated in FIGS. 1, 1A and 1B occurs about from 1:30 to 3:00 o'clock of the cycle, but it could occur, say, about from 1:00 to 2:30 o'clock or about from 2:30 to 4:00 o'clock. Other motions can be varied as well.

With further reference to the drawings, notably FIGS. 2 et seq., which may be viewed in light of FIGS. 1, 1A and 1B, as well as other figure(s), a general assembly of a progressive type die with a movement device, and components of or for the same are depicted. The movement device is for transferring parts through the die.

Figure 2A:
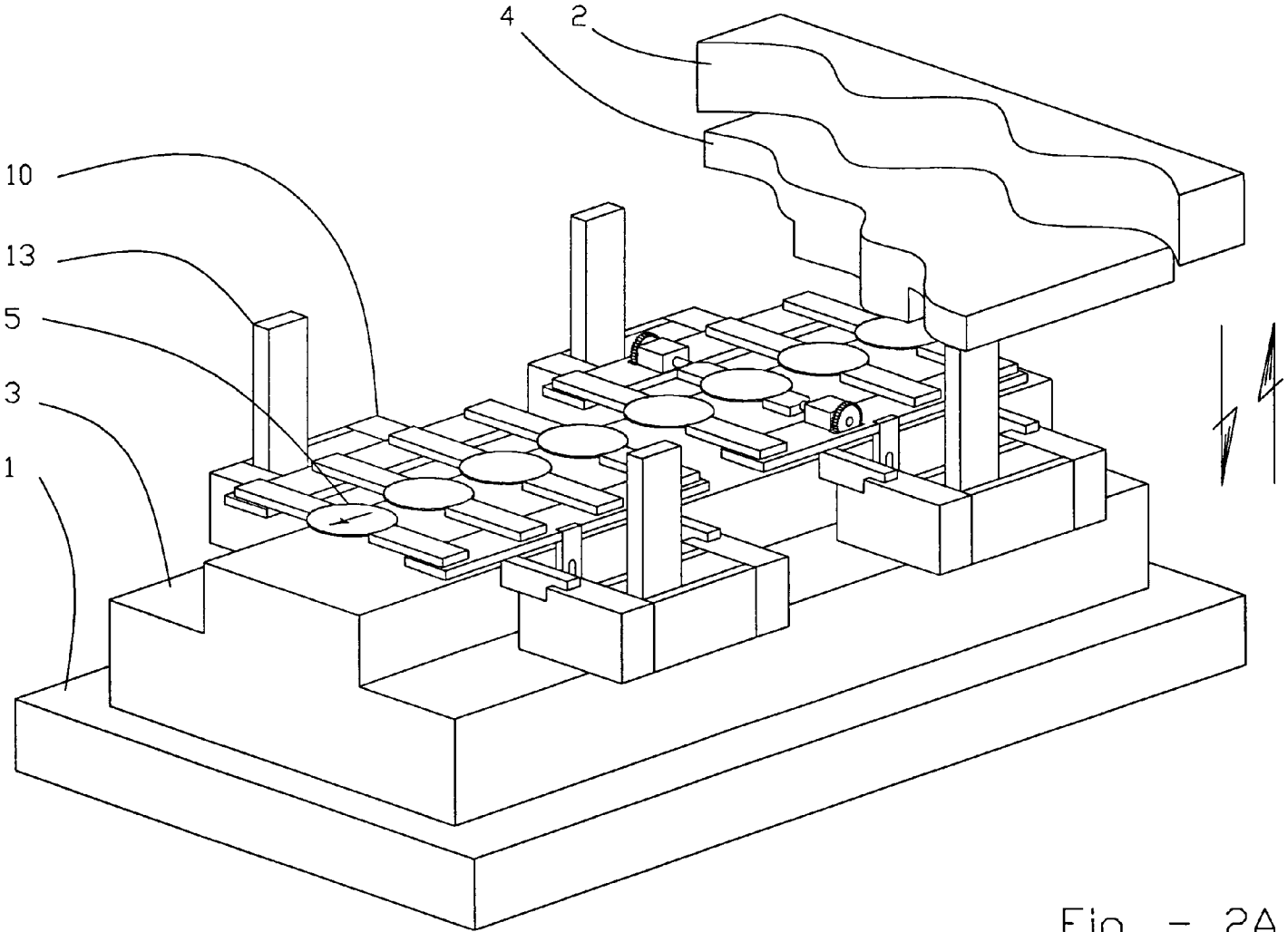

As initially illustrated in FIGS. 2 and 2A, the general assembly can include die components of a stationary lower press bolster 1; movable press ram 2, which moves up and down; stationary lower die 3, which is attached to the lower press bolster 1; and movable upper die 4, which is attached to the movable press ram 2. Work piece 5, which may be referred to as or formed into a part or stamping, is supplied for operation at various station(s). The movement device can include base 10, which is attachable to tooling plate 11, which attaches to end effector 12 for handling the work piece 5; also included is rack driver 13, which is attachable to the movable press ram 2 and/or upper die 4, say, attached directly to the upper die 4, and is to move slaved from or in conjunction with the movable press ram 2 and upper die 4.

Figure 3:
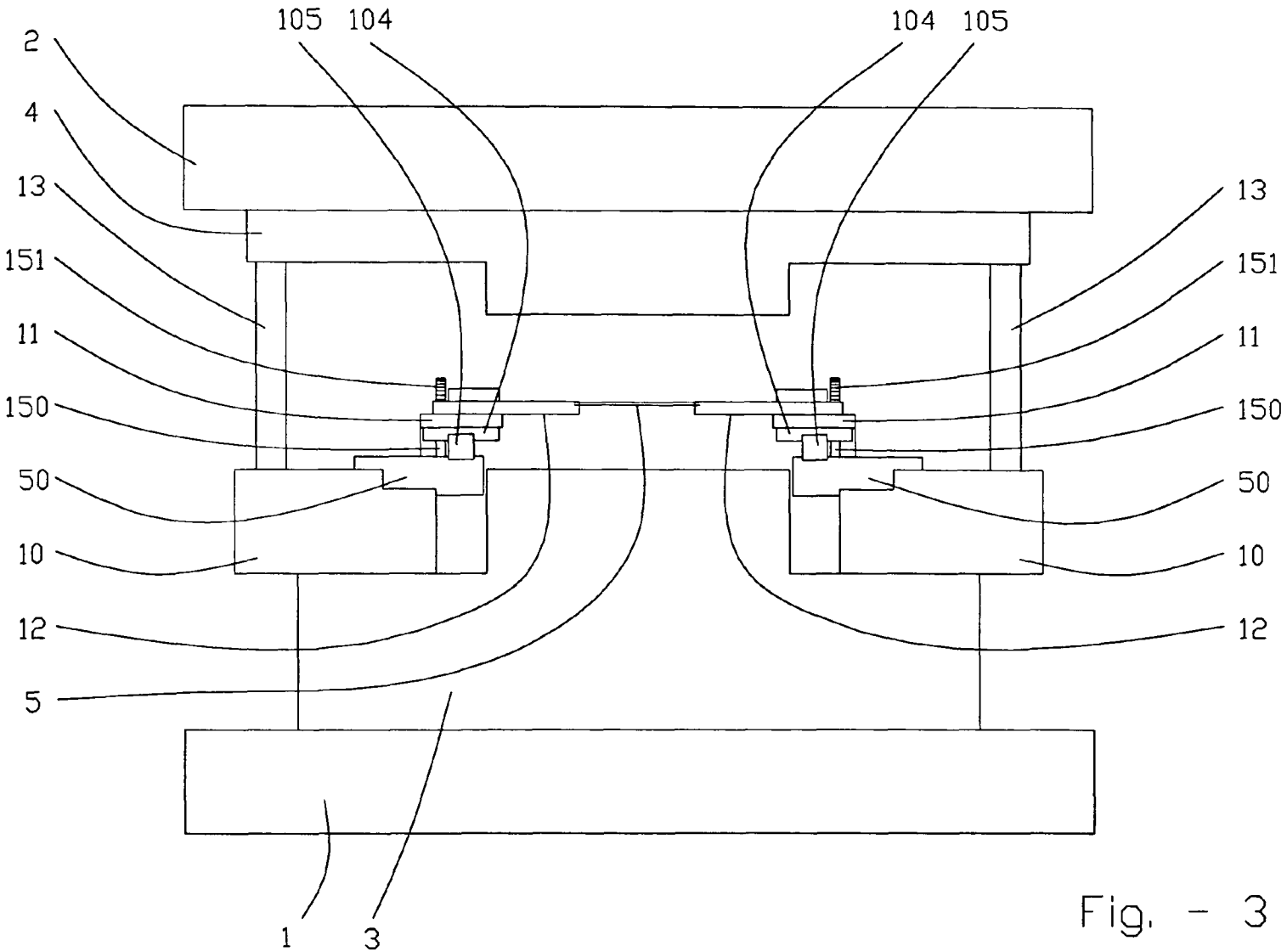
FIG. 3 is an end elevation view taken along arrow "E3" in FIG. 2, which shows the assembly of FIG. 2 at about 12:00 o'clock.

As further illustrated in FIG. 3, drive and elevation transfer mount 50 slides with respect to the base 10; movable truck 104 may have low friction surface such as a sliding rail or may have bearings, say, linear bearings, and may be configured with female receptacle to engage male projection of slide mount 105, which is stationary relative the sliding motion of the truck 104 and is attached to the drive and elevation transfer mount 50. Pivot rack 150 is connectable to the mount 50, and it also engages pivot pinion gear 151 for rotation of an unattached work piece 5.

As additionally illustrated in FIG. 4, the base 10 can include guide channel 10A for the drive and elevation transfer mount 50 and its associated drive wedge 51; inner guide channel stop wall 10B; and upper guide channel clearance shoulder 10C. The tooling plate 11 can be provided with clearance channel 11A for allowing the pivot gear 151 to pass through the tooling plate 11 to engage the pivot rack 150. Outer base retainer 14 and inner base retainer 15 can connect opposing bases 10. The drive and elevation transfer mount 50 can have drive and elevation transfer mount outer surface 50A. Pitch (progress) pinion gear 100 is connectable to progress actuating member 101, which, although it may be in any suitable form, say, a plate or arm, is efficiently provided, for example, in the form of an arm, and which, at a radially movable extremity thereof, is connected to progress drive pin 102. Retaining member 101R can be in a form of a set of detent pins, each with, for instance, spring biased detent ball 101R' provided so as to hold a member in place until released. The progress drive pin 102 engages progress drive yoke 103 in progress drive yoke slot 103A. The progress drive yoke 103 is fixed to the tooling plate 11. Progress gear shaft 106 can connect directly or can be connectable, say, by riding on bearing 106B, to the progress pinion gear 100 and a pivot end of the progress actuating arm 101. The pivot gear 151 is attachable through employment of pivot block 152 attached to the tooling plate 11 by rotatable pivot shaft 153, to pivoting end effector 154 for rotation of a rotatable part. Screw(s) 88 can be employed to fasten components or parts of the movement device together.

As further illustrated in FIGS. 5 and 5A, which show lost motion rack and pinion systems, the pivot rack 150 includes pivot rack teeth 150A for engaging teeth 151A of the pivot gear 151, which may be relatively simple (FIG. 5) or have additional structure associated with it (FIG. 5A). Thus, in general, the part 5 can be rotated. Further, as shown in FIG. 5A, rotation is generally made from forward (F) and return (R) motions of the tooling plate 11 with respect to the pivot rack 150; and defined or provided with the pivot rack 150 so as to improve its operation can be on one side of the pivot rack teeth 150A forward rack flat surface 150F and on the other side of the pivot rack teeth 150A return flat rack surface 150R, on which can slide, respectively, pivot gear protrusion forward flat surface 151F and pivot gear protrusion return flat surface 151R of a pivot gear protrusion of the pivot gear 151, which also may be equipped with transition teeth 151T that are typically shorter and more flat tipped, and may have at the start or end of the shorter teeth a taller tooth or surface to initiate or conclude the radial motion, in comparison with and to lead smoothly and securely into the generally longer and more pointed pivot rack teeth 150A. The rotatable pivot shaft 153 can have angle 153A to attached pivot shaft boss 153B with respect to forward flat surface 153F and return flat surface 153R, which slidingly engage, respectively, forward flat surface 153F' and return flat surface 153R' with the pertinent corners of the boss 153B able to rotate in notch 153N of pivot positioning member 153P. The angle 153A can be set so as to predetermine the amount of rotation. In general, features 150F, 151F and 153F, 153F' correlate, as do features 150A, 153N, as do features 150R, 151R and 153R, 153R'.

As further illustrated in FIG. 6, the drive wedge 51 associated with the drive and elevation transfer mount 50 can be provided with drive and elevation pin receiving channel 51A. Drive and elevation actuating member 52, which, although it may be in any suitable form, say again, a plate or arm, is efficiently provided, for example, in the form of an arm, pivots with respect to connected drive and elevation actuating shaft 53, which can have spacer or thrust washer 53W so as to assist in controlling the position of connected drive and elevation actuating pinion gear 54 as well as the drive and elevation actuating shaft 53. Drive and elevation pin 55 is received in the drive and elevation pin receiving channel 51A of the drive wedge 51. Distance 52D between the center of pivoting of the drive and elevation actuating shaft 53 and drive and elevation pin 55 can be varied to vary the drive motion out, say, by making a first drive and elevation actuating arm 52 with one location for receiving the shaft 53 and another single location for receiving the pin 55 at a first predetermined distance 52D and by making a second drive and elevation actuating arm 52 with one location for receiving the shaft 53 and another single location for receiving the pin 55 at a second predetermined distance 52D different from the first, or by providing intrinsic variability in the predetermined distance 52D of a drive and elevation actuating arm 52 through provision of a set location for receiving the shaft 53 and a set of modular type holes 52M each of which provides a location for receiving the pin 55 at a variable predetermined distance 52D. For example, as illustrated herein, if the distance 52D is one inch, then the drive motion out is two inches; if 1-¼ inches, then 2-½ inches of drive out, and so forth. Engagement/release slot 52E may be provided to clamp down and release the shaft 53 and pin 55 inserted into the appropriate receiving hole of the drive and elevation actuating arm 52 by tightening and loosening, respectively, the screws 88. Dimensions of various other components can be made to predetermine the distance of motions also. For example, elevation wedge face angle dimension 50D can be made more toward the perpendicular with corresponding angle 50D' changed accordingly to increase the lift of the elevation motion, and vice versa; drive and elevation actuating member distance 52D can be lengthened or shortened to lengthen or shorten, respectively, distance out of the drive motion; and progress actuating member distance 101D can be lengthened or shortened to lengthen or shorten, respectively, the pitch. This may be done along the lines set forth above with respect to the drive and elevation actuating arm 52, say, by providing the progress actuating arm 101 in two or three or more different sizes with different distances 101D between receptacles for the shaft 102 and shaft 106, or, by providing intrinsic variability in the predetermined distance 101D of a progress actuating arm 101 through provision of a set location for receiving the shaft 106 and a set of modular type holes 101M each of which provides a location for receiving the shaft 102 at a variable predetermined distance 101D. For example, as illustrated herein, if the distance 101D is three inches, then the pitch motion forward is six inches; if 2-½ inches, then five inches of pitch motion forward, and so forth. Engagement/release slot 101E may be provided to clamp down and release the shafts 102, 106 inserted into the appropriate receiving hole of the progress actuating arm 101 by tightening and loosening, respectively, the screws 88. Other components may need to be adjusted accordingly. For an example, in line with basic parametric principles, the yoke 103 and yoke slot 103A may need to be lengthened when employed in conjunction with a longer progress actuating arm 101 and/or a higher lift elevation motion. Seat 101S can engage the spring biased detent ball 101 R' so as to provide a secure stopping point to position forward and reverse motion of the progress actuating arm 101.

As further illustrated in FIG. 7, rotation of the drive and elevation actuating pinion gear 54 rotates the drive and elevation actuating arm 52 upward and outward. This motion pulls the drive wedge 51 outward, causing the drive and elevation transfer mount 50 to move downward and then outward, which causes outward movement with de-elevation of the truck 104, slide mount 105 and tooling plate 11.

As further illustrated in FIG. 8, rotation of the progress pinion gear 100 rotates the progress actuating arm 101. This motion moves the progress drive yoke 103, which is fixed to the tooling plate 11, correspondingly moving it.

As additionally illustrated in FIG. 9, which shows another lost motion rack and pinion system, the rack driver 13 is an elongate member, which may be in a shape of a rectangular box or any other suitable shape. As illustrated, it includes modular progress rack receiving notch 13A; modular progress rack stopping upper shoulder 13B; and modular progress rack stopping lower shoulder 13C. Drive and elevation gear module notch 13A', drive and elevation gear lower flat engaging surfaces 13B' and drive and elevation gear upper flat engaging surfaces 13C' are present. The drive and elevation pinion gear 54 includes teeth 54A; first flat 54B, across which can slide the lower flat engaging surfaces 13B' to provide a first period of lost motion in drive and elevation; and second flat 54C, across which can slide the upper flat engaging surfaces 13C' to provide a second period of lost motion in drive and elevation. Modular drive and elevation rack 56 can be inserted into the corresponding notch 13A' in the rack driver 13, and it includes teeth 56A for engaging the teeth 54A of the gear 54 for actual drive and elevation motion. Expansion/compression slot 54S may be provided to assist in connecting the drive and elevation actuating pinion gear 54 to a corresponding drive and elevation actuating shaft, and securing such with a screw 88. Modular progress rack 107 can be inserted into and slide on corresponding surfaces of the notch 13A. The progress pinion gear 100 includes teeth 100A. The rack 107 includes teeth 107A for engaging the teeth 100A of the gear 100; upper surface 107B that can be engaged by the modular progress rack stopping upper shoulder 13B; and lower surface 107C that can be engaged by the modular progress rack stopping lower shoulder 13C. Keeper 114 may take the form of a plate that is fastened to the rack driver 13, say, by the screws 88. Varying the size of the notches 13A, 13A' in the rack driver 13, or the size of the modular components 56, 107 or gears 54, 100, or the extent and/or size of teeth 54A, 56A, 100A, 107A in such components 56, 107 and gears 54, 100 can alter the existence or extent of movement consequently provided a part, and modularity can increase ease of repair and versatility of the movement device and hence the die.

As further illustrated in FIGS. 10-13, which show another lost motion rack and pinion system and may be viewed in light of FIG. 9, at about 12:00 o'clock, the rack driver 13 would begin its descent, starting to be slaved downward; the modular progress rack 107 is at an upper point but with the lower shoulder 13C and surface 107C touching, and with appropriate surfaces of the notch 13A about to slide along appropriate surfaces such as rear surface 107D of the modular progress rack 107 to provide lost motion with respect to progress. At about 3:00 o'clock, the upper shoulder 13B of the rack driver 13 would engage the upper surface 107B of the modular progress rack 107, with the gear 100 about to engage the rack 107 through interaction of the teeth 100A and 107A and rotation of the progress actuating arm 101 about to commence. At about 6:00 o'clock, the rack driver 13 has driven the modular progress rack 107 to a low point with consequent turning of the progress actuating arm 101 to its full extent. Continuation of the cycle would lift the rack driver 13 for a period of lost motion until the lower shoulder 13C and surface 107C touch, whereupon the modular progress rack 107 would be lifted up with consequent rotation of the progress actuating arm 101 through engagement of the teeth 100A, 107A until the 12:00 o'clock position, more or less, was reached. Such an embodiment is simple and robust, with a change of teeth or extent of spacing able to conveniently change the extent of lost motion.

As illustrated in FIGS. 13-17, which show another lost motion rack and pinion system, modular progress rack 107' is stationary with respect to the rack driver 13. Such an embodiment can include in the inner base retainer 15 semicircular dog access channel 15A; and shaft receiving hole 15B centrally located with respect to the channel 15A. Progress pinion gear 100' has teeth 100A' that engage the teeth 107A of the modular progress rack 107'. Shaft 106' rotates in the hole 15B. Rotating catch 108, which is attached to the pinion gear 100' by the screw 88, rotates on the shaft 106' and with the gear 100'. The catch 108 includes opposing catch surfaces 108A, 108B. The dog 109 hits the catch 108, which is connected to the progress actuating arm 101 at a radially movable position, and the arm 101 is fixed to the shaft 106'. The dog 109 passes through the dog access channel 15A. At about 12:00 o'clock, the dog 109 is in contact with the catch surface 108B, and, although the gear 100' and catch 108 may turn with the lowering of the rack driver 13 and modular progress rack 107', there is no effective motion of the arm 101 and the dog 109. At about 3:00 o'clock, with the slave motion of the rack driver 13 and modular progress rack 107' advanced downward, the dog 109, having been engaged by the catch 108 on its surface 108A, would move through the channel 15A with consequent movement of the progress actuating arm 101. At about 6:00 o'clock, with the slave motion of the rack driver 13 and modular progress rack 107' advanced to their greatest downward extent, the dog 109 and the arm 101 are stopped at a position opposite where they were at about 12:00 o'clock. Continuation of the cycle would lift the rack driver 13 for a period of lost motion, and eventually swing the arm 101 to the position it had at about 12:00 o'clock. Such a rotating catch embodiment is robust and efficient, and it is simple to change the extent of motion or lost motion with a change of the configuration of the catch 108, say, from having its surfaces 108A, 108B configured to be at a predetermined angle dimension 108D, for example, about 180° to each other on the catch 108, to having the catch configured so that the surfaces 108A, 108B form an acute or an obtuse angle 108D with respect to one another. Bearings 106B, washer 106W and additional screws 88 may be provided to assist in construction and operation.

As illustrated in FIGS. 18-21, which show another lost motion rack and pinion system, the modular progress rack 107' also is stationary with respect to the rack driver 13. Such an embodiment can be mounted with the inner base retainer 15, and include the progress pinion gear 100 and progress actuating arm 101. The gear 100 is fixed on one end of primary progress shaft 106", which has projection or boss 106A on its other end. The gear 100 with its teeth 100A is engaged by the modular progress rack 107' with its teeth 107A. Dog 110 is connected to dog arm 111, which is fixed to the shaft 106" near its boss end. Catch 112 is connected to secondary progress shaft 113, which includes boss receiving hole 113A for receiving and allowing rotation of the boss 106A therein. Also, the pivot end of the progress actuating arm 101 is fixed to the secondary progress shaft 113 at the end opposite the hole 113A. At about 12:00 o'clock, the dog 110 is in contact with catch surface 112A, and, although the gear 100, dog 110 and dog arm 111 may turn with the lowering of the rack driver 13 and modular progress rack 107', there is no effective motion of the arm 101 and the catch 112. With the slave motion of the rack driver 13 and modular progress rack 107' advancing downward, the dog 110 would move until it strikes the catch surface 112B, thus turning the arm 101. At about 6:00 o'clock, with the slave motion of the rack driver 13 and modular progress rack 107' advanced to their greatest downward extent, the dog 110 and arm 101 are stopped at a position opposite where they were at about 12:00 o'clock. Continuation of the cycle would lift the rack driver 13 for a period of lost motion, and eventually swing the arm 101 to the position it had at 12:00 o'clock. Such an embodiment thus employs a rotating dog 110; it is efficient and can be changed to provide another extent of motion or lost motion by alteration of its components with respect to the angle dimension 112D.

As further illustrated in FIGS. 22-24, which show another lost motion rack and pinion system and may be viewed in light of FIG. 9, at about 12:00 o'clock, the rack driver 13 would be about to begin its descent, starting to be slaved downward, and the modular drive and elevation rack 56 would move with it; the flat surfaces 13B' and 54B would be about to slide with respect to each other and a period of lost motion with respect to drive and elevation would result. At about 3:00 o'clock, the drive and elevation pinion gear 54 and modular drive and elevation rack 56 would be engaged through their respective teeth 54A, 56A, with the rack driver 13 descending; at this stage, the drive and elevation actuating arm 52 with its attached drive and elevation pin 55 would be rotating. At about 6:00 o'clock, the rack driver 13 would be at the bottom of its stroke, with the drive and elevation actuating arm 52 having been fully rotated and with the flat surfaces 13C' and 54C having slid with respect to each other for another period of lost motion with respect to drive and elevation. Continuation of the cycle would lift the rack driver 13 for a period of lost motion, and after swinging the arm back, would provide another period of lost motion, eventually leaving the arm 52 and gear 54 at the positions they had at about 12:00 o'clock.

Figure 50:
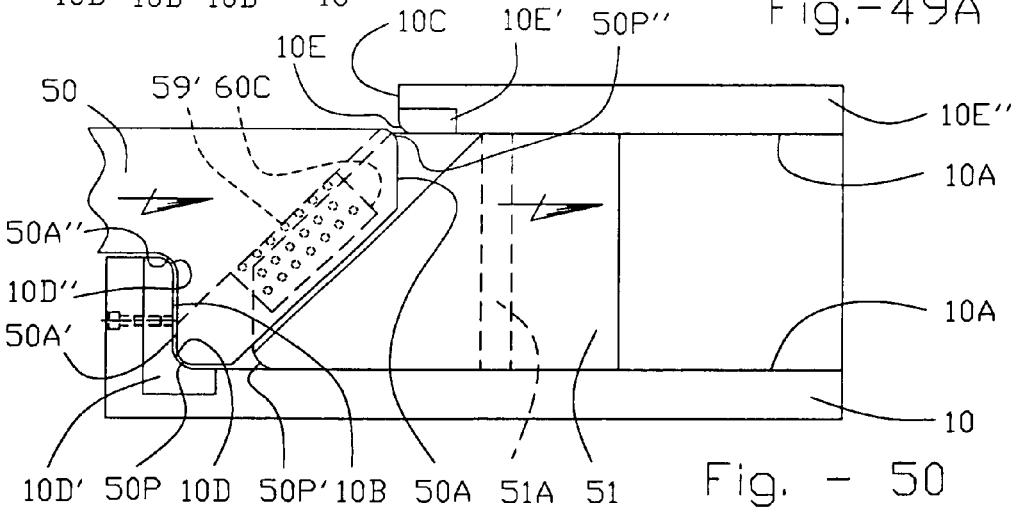

As illustrated further in FIGS. 25-30, FIGS. 31-33, FIGS. 34-36, FIGS. 37-39 and FIGS. 40-42 and yet further in FIGS. 49-51, the drive and elevation transfer mount 50 and its associated drive wedge 51 generally can reside in the guide channel 10A of the base 10. Inner guide channel stop wall 10B and upper guide channel clearance shoulder 10C may be present, and the base 10 may have lower overlap corner 10D and upper overlap corner 10E. Modular inserts 10D' and 10E' can be provided to alter profile configurations, say, with the insert 10D' for a lower portion of the base 10 and the insert 10E' a separate component for insert in base upper element 10E". To provide overlap between such motions as the drive and elevation motions, additional corner 10D" as an interaction surface may be provided so as to interact with the interaction profile 50A"; interaction profile 50P can interact with the surface 10D, with clearance profile 50P' generally provided so that it can avoid interaction with the surface 10D for smoother operation; and/or interaction profile 50P" can interact with profile 10E—noting that, in general, there must be one or both interaction(s) of the surfaces 10D" with 50A" and/or the surfaces 50P with 10D, plus there must be interaction between the surfaces 10E and 50P" (FIGS. 49 and 50). Such profile surface interactions can control motion overlap profiles 99A, 99B, 99C (FIGS. 49A, 49B, 49C) between the drive and elevation motions by employment of parametric principles known to persons skilled in the art. At about 12:00 o'clock, the drive and elevation transfer mount 50, having been moved through inward displacement of the drive wedge 51 through force applied to the drive and elevation pin receiving channel 51A from the drive and elevation pin 55, has a period of no motion. This is followed by the motion of de-elevation caused from initial outward displacement of the wedge 51 through outward force applied to the drive and elevation pin receiving channel 51A from the drive and elevation pin 55. The drive and elevation transfer mount outward surface 50A clears the upper guide channel clearance shoulder 10C, and drive and elevation transfer mount inner surface 50A' slides along the inner guide channel stop wall 10B. At about 3:00 o'clock, with continued outward movement of the wedge 51, the mount 50 reaches its lowest position, and drive outward of the mount 50 has begun. Continuation of the cycle would result in further outward motion, a period of lost motion, drive in, elevation up, and a period of no motion with respect to drive and elevation until the 12:00 o'clock position, more or less, was again reached. Such overlap corners as the corners 10D, 10D", 10E, 50A", 50P and 50P" and so forth and the like may be considered to be profile surfaces, which, if, for a simple example, both are squared or both have equal radii, overlap between drive and elevation could effectively be set to zero; but which, if, for another simple example, a pertinent profile surface, say, the surface 10D, is rounded, say, with a ¼-inch radius, while the corresponding profile surface, say, the surface 50P, was square, then, a ¼-inch overlap between drive and elevation could be effectively provided. Again, parametric principles known to a person skilled in the art would be employed. Whereas known devices typically have a fixed ¼-inch or so overlap between drive and elevation, if elevation is provided, hereby, overlap between drive and elevation can be controlled by predetermining it from zero to ½ inch, or even ¾ of an inch or more. Other profile configurations such as having multiple curved and/or linear portions and so forth are possible. The modular inserts 10D', 10E' can assist in providing and changing such profile configurations. Various types of association between the mount 50 and wedge 51 can be provided to transfer motion between the wedge 51 and the mount 50. For example, interlocking sliding surfaces can be provided where mount surface 50B engages and slides across wedge surface 51B such as, in cross-section, a T-bar in an undercut groove (FIG. 27); a dovetail (FIG. 28); a rounded head and undercut groove (FIG. 29); and interlocking fingers (FIG. 30). Also, association between the mount 50 and wedge 51 may be provided by keepers 57, which have sliding surfaces 57B, each keeper 57, say, with an internal groove to hold opposing T-bar projections from the mount 50 and wedge 51 (FIGS. 31-33); key fastener 58, which has sliding surface 58B, and which slides and pins the mount 50 and wedge 51 together (FIGS. 34-36); bearings 59 held in a plate keeper or race 60 to provide surface 60B or kept from falling down by pin 60' as a keeper in lieu of the race 60 (FIGS. 37-39) or a blind lower channel in either or both of the mount 50 or the wedge 51 in lieu of the pin 60'; or rail 61 with bearing track on which can slide truck 62 with linear bearings so as to keep the mount 50 with the wedge 51 (FIGS. 40-42). Bearings 59' in cage 60C, which can be cut out from a commercially available cylindrical guide pin roller bearing cage to accommodate neck 51N of the wedge 51, may be provided in a rounded head and undercut groove configuration and contact the surface 50B and 51B so that minimal friction are encountered (FIGS. 49-51). Elevation motion can be avoided or eliminated by making such components as the mount 50 and wedge 51 as one piece or by fixing the mount 50 to the wedge 51 as by fasteners with corresponding parts of the base 10 that otherwise may interfere with the drive motion eliminated, or with such a one-piece or fixed drive member configured to avoid parts of the base 10 that otherwise would provide for interference and forced elevation with the mount 50 and wedge 51, or by a shorter drive and elevation actuating arm 52. Drive and elevation motion profile paths, which can relate to such embodiments as from the foregoing, can include the square corner profile 99A, which provides no overlap between drive and elevation (FIG. 49A); the rounded corner profile 99B, which provides a radial type of overlap between drive and elevation (FIG. 49B); and a multiple curve corner profile 99C, which provides a non-linear type of overlap between drive and elevation (FIG. 49C). Such motion paths 99A, 99B, 99C relate to the interaction profiles taken by end effectors.

As additionally illustrated in FIG. 43, rotation can be provided in conjunction with progress by a cam contrivance to rotate a rotatable part. Tooling plate 11' has attached end effectors 12 and pivot block 152'. Rotatable pivot shaft 153' is connected about one end to pivoting end effector 154' for rotation of the part 5 and is connected about an opposing end to rotatable pivot arm 155. Plate cam 156 has slot 156A into which pivot arm pin 157 goes. At about 12:00 o'clock, no motion is provided, but shortly thereafter, with movement of the tooling plate 11' and its attached components relative the plate cam 156, the pin 157 is guided through the slot 156A, which rotates the arm 155, hence the shaft 153', end effector 154', and part 5. With such a cam contrivance, rotation not only can be keyed into another motion but can be varied depending on the configuration of the slot 156A.

As additionally illustrated in FIG. 44, commercially available linear bearing assembly can be for or include rail 104' with bearing track 104A, and have truck 105' with inner track with ball bearings 105A and opening 105B for access of the balls 105A. Such a linear bearing assembly in conjunction with the rail 104' can be employed to assist progress motion or to be used in any other suitable location. See also, FIGS. 40-42.

As further illustrated in FIG. 45, again, the base 10 can include guide channel 10A for the drive and elevation transfer mount 50, and be attached directly or indirectly to the tooling plate 11, which can be provided with the clearance channel 11A for allowing the pivot gear 151 to pass to engage the pivot rack 150 and which attaches to the end effector 12; there are provided the rack driver 13 and outer and inner base retainers 14, 15 as well as the pitch pinion gear 100, progress actuating arm 101, progress drive pin 102, progress drive yoke 103 with its slot 103A, movable truck 104 and slide mount 105, plus the progress gear shaft 106; also, there are the pivot block 152, rotatable pivot shaft 153 and pivoting end effector 154. Compare, FIG. 4. The base 10 also can have with respect to each channel 10A modular stop wall 10B; the modular insert 10D'; base lower member 10L; the base upper element 10E", which can contain the modular insert 10E' (FIGS. 25, 26, 49 and 50); base outer side wall 10S; and base inner side wall 10S'. Such an element as the upper element 10E" and/or outer side wall 10S and perhaps even the inner side wall 10S' can be readily removable and replaceable so as to provide for changing or readjusting of modular parts as, for example, a different drive and elevation actuating arm 52 or moving of the pin 55 into a different modular hole 52M. So as to help maintain alignment and smooth movement during the cycle, the rack driver 13 can include modular progress rack sliding shoulder surface 13S' and have associated with it rack driver guide 13G; rack driver guide static surface 13G' has moving rack driver surface 13G" slide along it; and rack shoulder guide static surface 13S has the moving surface 13S sliding along it. The retaining member 101R in a form of a detent pin with the spring biased detent ball 101R', which may otherwise or in addition be provided with a pneumatic pin, magnet and so forth and the like, can be provided in the base 10, say, in a base inner side wall 10S' with seat 101S' for engaging the spring biased detent ball 101R' in a radially rotatable extremity of the progress actuating arm 101 so as to provide a stopping point to restrain back an forth motion of that arm 101 at a first stopping position. Shaft retainer 106R may be provided so as to hold the progress gear shaft 106 until released.

As further illustrated in FIG. 46, which shows another lost motion rack and pinion system, the rack driver 13 can be configured to include a modular progress rack receiving notch 13A; modular progress rack stopping upper shoulder 13B; and modular progress rack stopping lower shoulder 13C. A modular progress rack 107 can be inserted into the notch 13A, and can include teeth 107A for engaging the teeth 100A of the progress pinion gear 100; upper surface 107B to register at least in part with the modular progress rack stopping upper shoulder 13B; and lower surface 107C that can register at least in part with the modular progress rack stopping lower shoulder 13C. The progress pinion gear 100 includes teeth 100A. Modular drive and elevation gear module notch 13A' can be provided, into which drive and elevation insert member lower flat engaging surface 13B' and drive and elevation insert member upper flat engaging surface 13C' are present as part of modular drive and elevation rack insert member 56 on either side of drive and elevation insert member gear teeth 56A. Adjacent thereto can be modular drive and elevation rack positioning member 13P that includes lower flat 13L and notch 13N for accommodating protruding portion of square or otherwise flat surface endowed shaft 53, which has first face 53F for sliding along upper flat 13U and opposing second face 53F' for sliding along the lower flat 13L, and which connects to the drive and elevation gear 54 having teeth 54A to engage the teeth 56A; flat surface 54B to slide along the flat surface 13B'; and flat surface 54C to slide along the flat surface 13C'. The drive and elevation pinion gear 54 may be provided transition teeth 54T, configured, again, in general, to be typically shorter and more flat tipped than the teeth 54A, and so forth, as before, and which serve to disengage and reengage, respectively, the rack teeth 56A so as to provide the drive and elevation gear 54 periods of no motion, i.e., dwell. Analogous transition teeth may be provided on the rack 56. The side by side locations of the positioning member 13P and the adjacent rack insert member 56 may be switched with one other as may be appropriate. As can be seen, these inserts including this rack 107 are static with respect to the rack driver 13.

As further illustrated in FIG. 47, the base 10 has a guide channel 10A, outer and inner base retainers 14, 15, and an outer side wall 10S, which accommodate and guide the drive and elevation transfer mount 50. Clearance 10A' is provided for the drive and elevation actuating arm 52, which pivots with the connected drive and elevation actuating shaft 53 in bearing 53B that has retaining collar 53C and race 53R, as mounted in a hole provided in an inner side wall of the base 10. The shaft 53 may have at least one planar surface 53F to it, for example, having a plurality of planar surfaces to it, say, by having a square cross section, otherwise perhaps to have a keyway and key and/or set screw arrangement or the like, so as to provide for more secure attachment and better precision. The retaining member 101R again may be in a form of a detent pin with the spring biased detent ball 101R' and be provided in an inner side wall to engage the extremity of the progress actuating arm 101 to provide a stopping point to restrain back an forth motion of that arm 101 at a second stopping point.

As further illustrated in FIG. 48, which shows yet another lost motion rack and pinion system, a period of intermediate no-motion, i.e., dwell, can be provided drive and/or elevation motions such as with a drive and elevation gear module for a rack driver, which can be employed in a rack driver as of FIG. 46. The modular drive and elevation insert member 56 has, in addition to the drive and elevation insert member lower flat engaging surface 13B' and drive and elevation insert member upper flat engaging surface 13C', intra-tooth drive and elevation member flat surface 13D' between upper drive and elevation insert member gear teeth 56A' and lower drive and elevation insert member gear teeth 56". Adjacent thereto is the modular drive and elevation rack positioning member 13P that has, in addition to the lower flat surface 13L and upper flat surface 13U, intra-notch drive and elevation rack positioning member flat surface 13D between upper drive and elevation rack positioning member notch 13N' and lower drive and elevation rack positioning member notch 13N" for accommodating, on the shaft 53, protruding portion of pentagonal or otherwise flat surface endowed boss 53B, which is associated with race 53R' and has first face 53RF for sliding along the upper flat 13U, opposing second face 53RF' for sliding along the lower flat 13L, and intermediate face 53RF" for sliding along intermediate flat 13D. As before, the shaft 53 connects to a drive and elevation gear 54 having teeth 54A to engage the teeth 56A; flat surface 54B to slide along the flat surface 13B'; and flat surface 54C to slide along the flat surface 13C'. In addition, the drive and elevation gear 54 has the transition teeth 54T, as well as the intra-tooth transition teeth 54T', and intra-transition teeth elevated flat surface 54D for sliding over the intra-tooth drive and elevation member flat surface 13D'. Again, both sets of transition teeth are typically shorter and more flat tipped than the teeth 54A, and may have other features such as flat areas, and so forth, as noted elsewhere herein. And again, the side by side locations of the positioning member 13P and the adjacent rack insert member 56 may be switched with one other as may be appropriate. As elsewhere herein, the screws 88 may be employed as fasteners. Also, the positioner 13P can be instrumental in reducing or eliminating backlash, which can improve the precision of the end position of an end effector.

As illustrated in FIG. 52, the movement device for a die can have a size not unlike that of a bread box. Dimensions are given in inches. Compare, FIGS. 4, 45 and so forth.

Figure 53B:
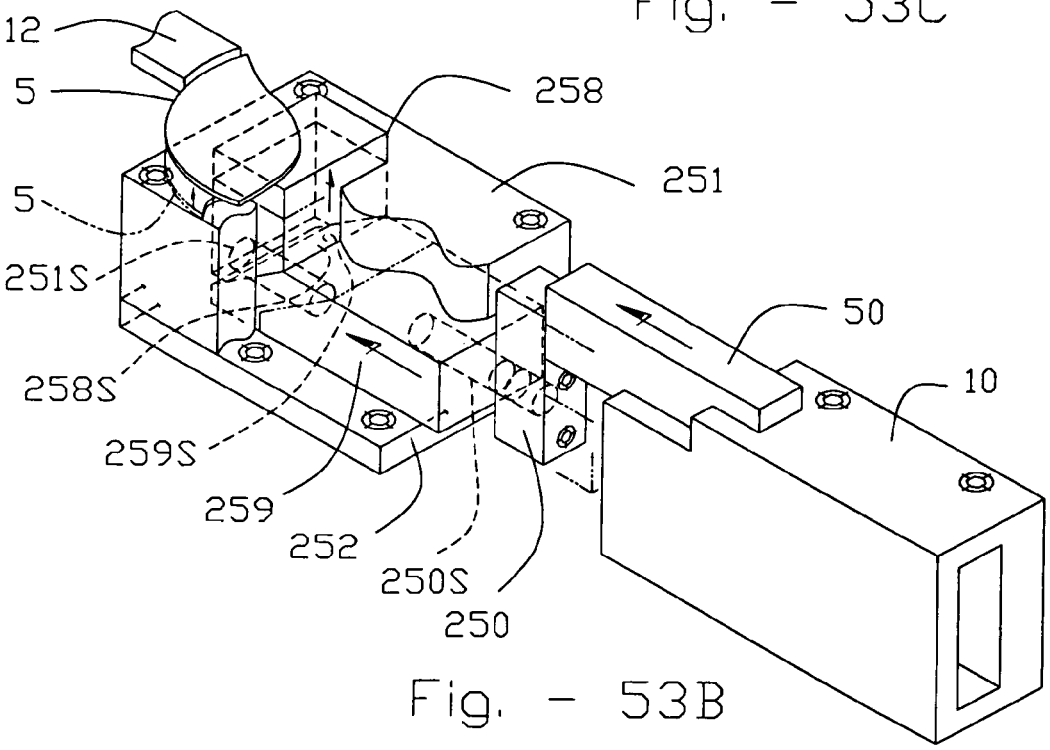

As further illustrated in FIGS. 53, 53A, 53B and 53C, the movement device for a die can have assisting motion contrivances, which may be in a form of a PTO from the pitch, drive and/or elevation or other motion(s). Thus, for instance, for moving the part 5, say, in conjunction with the end effector 12, the movement device may include the base 10; drive rack 13; drive and elevation transfer mount 50; progress pinion gear 100; and progress drive yoke 103, which may be provided in conjunction with extended progress drive pin 102'. In addition, assisting motion mount body 204 includes a hole or bearing through which goes first rotatable axle 205 on which first rotatable bevel gear 206 is securely mounted for the purpose of engaging second rotatable bevel gear 206A, with the axle 205 being fixedly mounted to a pivot hole in pendulum arm 207, which may include engagement/release slot 207A secured and released by screws and which at an opposing end rotatably connects to an extremity of the extended progress drive pin 102' so as to provide oscillating, rotating motion for the purpose of rotating the cooperating gears 206, 206A, which are mounted in a transmission case having base 208 with shaft bearing 208B, side 209 with shaft bearing 209B through which passes the rotatable shaft 205, and housing 210; bevel clearance pocket 211 may be provided; and rotating end effector 212 may have work piece engaging members 212G, say, in a form of pins, and is rotated by second shaft 213, which rotates in bearing 213B connected to the second bevel gear 206A (FIG. 53). From opposing bases 10 the opposing drive and elevation transfer mounts 50 may lift opposing elevation adapter mounts 300, each of which has drive-nullifying slot 300A in a respective arm of the mount 300 and is slidingly connected to opposing ends of drive-nullified lift bar 301 by slot engaging slide pins 302 near both its extremities, which slide in the slots 300A to lift the bar 301, which also has attached to it positioner shank 303 that slides up and down in positioner slot 306S in mount 306 and lift shank 304 for lifting and lowering elevator block 305 that may include work piece lead 305L so that a work piece transitions smoothly between die stations (FIG. 53A). Also, from the base 10 the drive and elevation transfer mount 50 may move elevation-nullifying drive block 250, which may be magnetically or mechanically connected to drive-to-elevation contrivance housing 251, say, mechanically as by fasteners such as screws and include as part of a spring return system back drive nullifying spring 250S for preventing damage to the drive system if elevation block 258 would be forced down at the die station at the wrong time and optionally also include return spring 251S, and which housing 251 may include base 252; the elevation block 258 has wedge surface 258S, which is engaged by wedge surface 259S of drive wedge 259 to raise and lower the elevation block 258 with drive in and drive out motions of the drive wedge 259 so as to work on the work piece (FIG. 53B). As well, the drive and elevation transfer mount 50 may move elevation-nullifying drive block 275, which can be connected to motion transfer slide block 276, and guided by guide block 277 having female guide block shoulder 277G; return spring retainer block 278 may be provided and hold return spring 278S; locator slide 279 can include both male guide shoulder 279G for cooperation with the female guide block shoulder 277G and locator slide surface 279S to assist in positioning the work piece 5 in conjunction with locator 281 with its locator static/net surface 281S to also assist in positioning the work piece 5 to be worked on by the die, thus providing an assisting drive motion, say, to position a gauge or work piece locator to obtain access to an otherwise inaccessible die station area (FIG. 53C). Accordingly, such and further assisting motions can take advantage of pre-established timing of the basic and/or additional motion(s) of the movement device, which can establish tight synchronization and efficiency between motions. So, an assisting motion may reposition a part for better die working conditions and part orientation, eject a part, move a flange, insert a stud into a hole, activate an element for an inspection process, lift at the correct time a flexible part, and so forth.

Additional embodiments are depicted in FIGS. 54, 54A, 54B, 54C and 54D. Thus, linear relations between pitch, drive and/or elevation, in addition to embodiments disclosed above, can be provided with planetary gearing in communication with a drive rack gear and a second rack gear (FIG. 54); a flat plane interface wedge system forced by a slave and returned by a spring (FIG. 54A); a scissors arm (FIG. 54B); and a ball screw (FIG. 54C). Non-linear relations between pitch, drive and/or elevation, in addition to rotating actuating arms as discussed above, can be provided with a wedge, in general, having engagement along a surface that is not a straight line or plane as, for example, one with a parabolic surface for engagement of the wedged member, which may be returned with a spring (FIG. 54D). Drive 13' provides motion from a slave in a straight line, and drive 13" provides motion from a slave as a rotation. In lieu of the return spring with the wedges, an interconnected drive 13' and receiving wedge system such as found within FIGS. 25-42 and 49-51 may be employed.

CONCLUSION TO THE INVENTION

The present invention is thus provided. Various feature(s), part(s), step(s), subcombination(s) and/or combination(s) may be employed with or without reference to other feature (s), part(s), step(s), subcombination(s) and/or combination(s) in the practice of the invention, and numerous adaptations and modifications can be effected within its spirit, the literal claim scope of which is particularly pointed out as follows:

I claim:

1. A movement device for a die, which comprises a mechanical converter secured to a housing, the mechanical converter including a slave member working component that provides a slave motion reciprocally along a first direction; a drive member working component that connects to and cooperates with the slave member to provide a drive motion reciprocally along a second direction different form the first direction; and a pitch member working component that connects to and cooperates with the slave member working component to provide a pitch motion in a third direction different from the first and second directions such that the mechanical converter converts the slave motion into basic motions of the drive, and the pitch motions, wherein the following also applies:

the mechanical converter, which provides conversion to the drive and pitch motions, is not through a plate cam or a rotating cam; and an elevation member working component, which provides for elevation motion in a fourth direction different from the second and third directions but including a vector component reciprocally along the first direction, is provided.

2. The movement device of claim 1, wherein the elevation member working component includes a wedge such that the elevation motion is provided through the drive motion by employment of the wedge.

3. The movement device of claim 1, wherein a lost motion rack and pinion system is employed, with a rack driver having a rack gear included with the slave member working component, and a pinion gear, which cooperates with the rack gear, included with at least one of the drive and pitch member working components.

4. The movement device of claim 1, further comprising a radial motion working component such that at least one additional motion radial to one or more of the first, second, third or fourth directions is provided from the aforesaid mechanical converter, another mechanical converter and/or from another source.

5. The movement device of claim 1, wherein at least one assisting motion is provided from a power take off transfer system from at least one of the drive, pitch and elevation motions of corresponding drive, pitch and elevation member working component(s).

6. The movement device of claim 2, wherein modular inserts are provided so as to predetermine overlap or absence of overlap with respect to the drive and elevation motions.

7. The movement device of claim 1, wherein the slave member working component is a rack driver with at least one rack gear mounted thereon to receive and transmit the slave motion, and at least one of the drive and pitch member working components includes a pinion gear for conversion into the drive and pitch motions.

8. The movement device of claim 7, wherein the at least one pinion gear embraces two separate pinion gears, a first pinion gear for the drive member working component for the drive motion and a second pinion gear for the pitch member working component for the pitch motion, with the drive motion being such that the first pinion gear turns an actuating arm about a portion of an arc of a circle, which generally is in communication with a tooling plate to provide the drive motion thereto, and with the pitch motion being such that the second pinion gear turns an actuating arm about a portion of an arc of another circle, which generally is in communication with the tooling plate to provide the pitch motion thereto.

9. The movement device of claim 7, wherein a period of lost motion is provided through employment of at least one of the following:

corresponding flat surfaces on at least one of the rack gears and on at least one of the pinion gears;

a sliding rack gear insert in the rack driver; and a rotary dog and catch.

10. The movement device of claim 7, wherein elevation motion is provided in conjunction with the drive motion by having the drive member working component being formed with a wedge that elevates as the drive member working component moves outwardly to elevate the tooling plate.

11. The movement device of claim 10, wherein modular inserts are provided so as to predetermine overlap or absence of overlap with respect to the drive and elevation motions of the drive and elevation member working components.

12. The movement device of claim 1, in combination with the die.

13. A movement device for a die, which comprises a mechanical converter secured to a housing, the mechanical converter including a slave member working component that provides a slave motion reciprocally along a first direction; a drive member working component that connects to and cooperates with the slave member to provide a drive motion reciprocally along a second direction different from the first direction; and a pitch member working component that connects to an cooperates with the slave member working component to provide a pitch motion in a third direction different from the first and second directions such that the mechanical converter converts the slave motion into basic motions of the drive and the pitch motions; wherein the mechanical converter that provides conversion to the drive and pitch motions is not through a plate cam or rotating cam; and at least one of the following features (A and/or B) is present:

(A) at least one of the pitch and drive motions provided by the pitch and drive member working components is non-linear with respect to the slave motion provided by the slave member working component;

(B) a lost motion rack and pinion system is employed to generate at least one of the drive and pitch motions, wherein a rack driver having rack teeth is included with the slave member working component, and a pinion gear that cooperates with the rack teeth of the rack driver is included with at least one of the pitch and drive member working components.

14. The movement device of claim 13, wherein the feature "A" is present, and the non-linear motion is harmonic.

15. The movement device of claim 13, wherein the feature "B" is present.

16. A movement device for a die, which comprises a mechanical converter secured to a housing, the mechanical converter including a slave member working component that provides a slave motion reciprocally along a first direction; a drive member working component that connects to and cooperates with the slave member to provide a drive motion reciprocally along a second direction different form the first direction; and a pitch member working component that connects to and cooperates with the slave member working component to provide a pitch motion in a third direction different from the first and second direction such that the mechanical converter converts the slave motion into basic motions of the drive and the pitch motions, wherein at least one of the following features (A, B and/or C) is present:

(A) the mechanical converter embraces a slave member working component that is a drive rack with at least one rack gear, and at least one of the drive and pitch member working components includes a corresponding pinion gear in communication with the at least one rack gear, and a period of lost motion is provided from the at least one rack gear and corresponding at least one pinion gear;

(B) modularity is provided in at least one of the following (i and/or ii):

(i) the drive rack with at least one rack gear such that the at least one rack gear can be predeterminedly interchanged with another at least one rack gear; and (ii) an insert in a base that guides a drive and elevation transfer mount having an associated drive wedge such that overlap or absence of overlap can be predetermined by employment of the insert in the base; and (C) an assisting motion is provided from a mechanical power take off system from at least one of the drive and pitch motions so as to provide for operation on a work piece when in the die.

17. The movement device of claim 16, wherein the feature "A" is present.

18. The movement device of claim 16, wherein said modularity (B) is provided.

19. The movement device of claim 16, wherein said assisting motion (C) is provided,

20. A method for making parts with a die having a movement device for the die, which comprises:

(I) providing the die;

(II) providing the movement device for the die, which embraces a mechanical converter secured to a housing, the mechanical converter including a slave member working component that provides a slave motion reciprocally along a first direction; a drive member working component that connects to and cooperates with the slave member to provide a drive motion reciprocally along a second direction different from the first direction; and a pitch member working component that connects to and cooperates with the slave member working component to provide a pitch motion in a third direction different from the first and second directions such that the mechanical converter converts the slave motion into basic motions of the drive and the pitch motions, wherein at least one of the following features (A, B, C, D, E and/or E) also applies:

(A) the mechanical converter, which provides conversion to the drive and pitch motions, is not through a plate cam or a rotating cam; and an elevation member working component, which provides for elevation motion in a fourth direction different from the second and third directions but including a vector component reciprocally along the first direction, is provided;

(B) the mechanical converter that provides conversion to the drive and pitch motions is not through a plate cam or rotating cam; and at least one of the pitch and drive motions provided by the pitch and drive member working components is non-linear with respect to the slave motion provided by the slave member working component;

(C) the mechanical converter that provides conversion to the drive and pitch motions is not through a plate cam or rotating cam; and a lost motion rack and pinion system is employed to generate at least one of the drive and pitch motions, wherein a rack driver having rack teeth is included with the slave member working component, and a pinion gear that cooperates with the rack teeth of the rack driver is included with at least one of the pitch and drive member working components;

(D) the mechanical converter embraces a slave member working component that is a drive rack with at least one rack gear, and at least one of the drive and pitch member working components includes a corresponding pinion gear in communication with the at least one rack gear, and a period of lost motion is provided from the at least one rack gear and corresponding at least one pinion gear;

(E) modularity is provided in at least one of the following (i and/or ii):

(i) the drive rack with at least one rack gear such that the at least one rack gear can be predeterminedly interchanged with another at least one rack gear; and (ii) an insert in a base that guides a drive and elevation transfer mount having an associated drive wedge such that overlap or absence of overlap can be predetermined by employment of the insert in the base;

(F) an assisting motion is provided from a mechanical power take off system from at least one of the drive and pitch motions so as to provide for operation on a work piece when in the die;

(III) installing the movement device for the die with the die;

(IV) providing stock for making parts;

(V) feeding the stock through the movement device for the die and operating the die while the stock is fed and moved such that the parts are made.

* * * * *

UNITED STATES PATENT AND TRADEMARK OFFICE

CERTIFICATE OF CORRECTION

PATENT NO. : 8,127,586 B1
APPLICATION NO. : 12/316058
DATED : March 6, 2012
INVENTOR(S) : Robert J. Gunst It is certified that error appears in the above-identified patent and that said Letters Patent is hereby corrected as shown below:

In claim 20, the parenthetical expression spanning lines 10-11 of column 24 should read as follows: "(A, B, C, D, E and/or F)."

Signed and Sealed this
Fifteenth Day of May, 2012

David J. Kappos

David J. Kappos
*Director of the United States Patent and Trademark Office*